US007012481B2

(12) United States Patent
Maekawa et al.

(10) Patent No.: US 7,012,481 B2
(45) Date of Patent: Mar. 14, 2006

(54) DUPLEXER, AND LAMINATE-TYPE HIGH-FREQUENCY DEVICE AND COMMUNICATION EQUIPMENT USING THE SAME

(75) Inventors: Tomoya Maekawa, Nara (JP); Hiroshi Shigemura, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/678,361

(22) Filed: Oct. 2, 2003

(65) Prior Publication Data

US 2004/0066256 A1 Apr. 8, 2004

(30) Foreign Application Priority Data

Oct. 4, 2002 (JP) ..... 2002-292173

(51) Int. Cl.
*H01P 1/213* (2006.01)
*H01P 1/203* (2006.01)

(52) U.S. Cl. ..... 333/134; 333/204

(58) Field of Classification Search ..... 333/134, 333/204, 205, 206
See application file for complete search history.

(56) References Cited

U.S. PATENT DOCUMENTS 5,497,130 A * 3/1996 Hirai et al. ..... 333/204
5,719,539 A 2/1998 Ishizaki et al.
5,986,521 A * 11/1999 Tada et al. ..... 333/134
6,140,891 A * 10/2000 Nakakubo et al. ..... 333/204
6,304,158 B1 * 10/2001 Nishijima et al. ..... 333/206
6,525,625 B1 * 2/2003 Tsukamoto et al. ..... 333/134

FOREIGN PATENT DOCUMENTS

| | | |
|---|---|---|
| DE | 100 36 977 | 6/2001 |
| EP | 0 840 390 | 5/1998 |
| JP | 6-112735 | 4/1994 |
| JP | 3204753 | 6/2001 |
| JP | 2002135005 A * | 5/2002 |
| JP | 2002-271109 | 9/2002 |

* cited by examiner

*Primary Examiner*—Seungsook Ham
(74) *Attorney, Agent, or Firm*—Hamre, Schumann, Mueller & Larson, P.C.

(57) ABSTRACT

A duplexer is composed of a laminate in which dielectric layers and electrode layers are laminated alternately. A first filter for transmitting and a second filter for receiving, having different pass band frequencies, are provided in the laminate. A matching circuit composed of a coupling line, having one end that is short-circuited and the other end that is connected to an external terminal, is provided between the first filter and the second filter. The first filter includes two first stripline resonators, each having one end that is short-circuited. The second filter includes two second stripline resonators, each having one end that is short-circuited. The coupling line is coupled to the first stripline resonator dose to the coupling line by electromagnetic field coupling. The coupling line is coupled to the second stripline resonator close to the coupling line by electromagnetic coupling.

24 Claims, 22 Drawing Sheets

DUPLEXER, AND LAMINATE-TYPE HIGH-FREQUENCY DEVICE AND COMMUNICATION EQUIPMENT USING THE SAME

BACKGROUND OF THE INVENTION

1. Field of the Invention

The present invention relates to a duplexer, and a laminate-type high-frequency device and communication equipment provided with the duplexer. More specifically, the present invention relates to an antenna duplexer sharing one antenna on a transmitting side and a receiving side and separating a transmitted signal and a received signal from each other, and a laminate-type high-frequency device and communication equipment provided with the antenna duplexer.

2. Description of the Related Art

In an antenna duplexer sharing one antenna on a transmitting side and a receiving side, and separating a transmitted signal and a received signal from each other, two filters having different center frequencies are connected. Therefore, it is required that, at a center frequency of one of the two filters, the impedance of the other filter seen from an antenna that is an input/output terminal shared by the two filters is set to be infinite, whereby the transmission characteristics of the one of the two filters are prevented from being impaired.

For this purpose, a duplexer as shown in FIG. 24 is proposed (e.g., see pages 4–5 and FIG. 3 in JP 3,204,753). FIG. 24 is an exploded perspective view of the duplexer in the prior art.

As shown in FIG. 24, a first end ground electrode (not shown) is provided on a lower surface of a dielectric layer 11*p*. Furthermore, a through-hole 91*p* for connecting the first end ground electrode to a tip portion of a transmission line 70*p* (described later) is formed in the dielectric layer 11*p*.

On an upper surface of a dielectric layer 14*p*, resonant elements 21*p*, 22*p*, 23*p*, 24*p*, and 25*p* are provided, each having one end that is connected to the first end ground electrode, respectively, to form a ¼ wavelength stripline resonator. Furthermore, on the upper surface of the dielectric layer 14*p*, electrodes 31*p*, 32*p*, 33*p*, 34*p*, and 35*p* are provided, each having one end that is connected to the first end ground electrode, respectively, and the other end that is opposed to open ends of the resonant elements 21*p*, 22*p*, 23*p*, 24*p*, and 25*p*, respectively, with a predetermined gap. A filter 500*p* in a comb-line shape is configured by using the distribution coupling of the resonant elements 21*p* and 22*p*, and a filter 600*p* in a comb-line shape is configured by using the distribution coupling of the resonant elements 23*p*, 24*p*, and 25*p*. Furthermore, on the upper surface of the dielectric layer 14*p*, the transmission line 70*p* for constituting an inductor between the resonant elements 22*p* and 23*p* is provided. A through-hole 94*p* is formed at the tip portion of the transmission line 70 so as to be connected to the first end ground electrode.

On an upper surface of a dielectric layer 12*p*, an inner layer ground electrode 81*p* positioned on an open end side of the resonant elements 21*p* and 22*p* and connected to the first ground electrode is provided, and dielectric layers 13*p* and 14*p* are interposed between the inner ground electrode 81*p* and the open end side of the resonant elements 21*p* and 22*p*. Furthermore, on the upper surface of the dielectric layer 12*p*, an inner layer ground electrode 83*p* positioned on an open end side of the resonant elements 23*p*, 24*p*, and 25*p* and connected to the first end ground electrode is provided, and the dielectric layers 13*p* and 14*p* are interposed between the inner layer ground electrode 83*p* and the open end side of the resonant elements 23*p*, 24*p*, and 25*p*. Furthermore, a through-hole 92*p* for connecting the first end ground electrode to the tip portion of the transmission line 70*p* is formed in the dielectric layer 12*p*.

On an upper surface of the dielectric layer 13*p*, a capacitive coupling electrode 50*p* is provided, one end 51*p* of which is overlapped with a part of the transmission line 70*p* with the dielectric layer 14*p* interposed therebetween and the other end 52*p* of which is overlapped with a part of the resonant element 23*p* with the dielectric layer 14*p* interposed therebetween. Furthermore, on the upper surface of the dielectric layer 13*p*, an input/output electrode 42*p* overlapped with a part of the resonant element 25*p* with the dielectric layer 14*p* interposed therebetween is provided. A through-hole 93*p* for connecting the first end ground electrode to the tip portion of the transmission line 70*p* is formed in the dielectric layer 13*p*.

The tip portion of the transmission line 70*p* is short-circuited with the first end ground electrode provided on the lower surface of the dielectric layer 11*p* via the through-holes 94*p*, 93*p*, 92*p*, and 91*p*. The through-hole 94*p* is positioned so that an electric length of the transmission line 70*p* is a predetermined length of 90 degrees or less. Thus, the transmission line 70*p* constitutes an inductor.

On an upper surface of the dielectric layer 15*p*, a capacitive electrode 60*p* is provided, one end 61*p* of which is overlapped with a part of the transmission line 70*p* with the dielectric layer 15*p* interposed therebetween, and the other end 62*p* of which is overlapped with a part of the resonant element 22*p* with the dielectric layer 15*p* interposed therebetween. Furthermore, on the upper surface of the dielectric layer 15*p*, an input/output electrode 41*p* is provided, a part of which is overlapped with a part of the resonant element 21*p* with the dielectric layer 15*p* interposed therebetween.

A second end ground electrode 110*p* is provided on an upper surface of a dielectric layer 17*p*.

On an upper surface of a dielectric layer 16*p*, an inner layer ground electrode 82*p* positioned on the open end side of the resonant elements 21*p* and 22*p* and connected to the second end ground electrode 110*p* is provided, and the dielectric layers 15*p* and 16*p* are interposed between the inner layer ground electrode 82*p* and the open end side of the resonant elements 21*p* and 22*p*. Furthermore, on the upper surface of the dielectric layer 16*p*, an inner layer ground electrode 84*p* positioned on the open end side of the resonant elements 23*p*, 24*p*, and 25*p* and connected to the second end ground electrode 110*p* is provided, and the dielectric layers 15*p* and 16*p* are interposed between the inner layer ground electrode 84*p* and the open end side of the resonant elements 23*p*, 24*p*, and 25*p*.

The dielectric layers 11*p*, 12*p*, 13*p*, 14*p*, 15*p*, 16*p*, a above-mentioned configuration are laminated to be integrated, followed by sintering, providing a duplexer composed of a laminate, in which dielectric layers and electrode layers are laminated alternately.

FIG. 25 shows an equivalent circuit of the duplexer having the above-mentioned configuration. As shown in FIGS. 24 and 25, a band-pass filter 500*p* is composed of the resonant elements 21*p* and 22*p*, and a band-pass filter 600*p* is composed of the resonant elements 23*p*, 24*p*, and 25*p*. A static capacitor 401*p* is formed between the capacitive electrode 60*p* and the transmission line 70*p*, and a static capacitor 402*p* is formed between the capacitive electrode 50*p* and the transmission line 70*p*. The inductor 403*p* is composed of the transmission line 70*p*. The inductor 403*p* is connected in parallel with the filters 500*p* and 600*p*, and the static capacitor 401*p* is connected in series between an antenna 700*p* and the filter 500*p*. The static capacitor 402*p* is connected in series between the antenna 700*p* and the filter 600*p*. The inductor 403*p*, and the static capacitors 401*p* and 402*p* constitute a branching circuit 400*p*.

FIG. 26 shows the transmission characteristics of a duplexer having the above-mentioned configuration. As shown in FIG. 26, it is understood that the branching circuit 400*p* shares one antennal on a transmitting side and a receiving side, and separates a transmitted signal and a received signal from each other.

As described above, the duplexer in the prior art includes a branching circuit provided between two filters in a triplet shape, in which resonant elements are provided integrally in a dielectric substrate. The branching circuit is configured by using static capacitors connected in series to each of the two filters and an inductor connected in parallel therewith.

However, in the above-mentioned configuration, the circuit configuration is complicated, so that a loss in the branching circuit is increased, and the layout space is necessarily increased. Furthermore, it is difficult to obtain a large L-value in the inductor connected in parallel with two filters, respectively, so that the degree of design freedom is lowered.

SUMMARY OF THE INVENTION

Therefore, with the foregoing in mind, it is an object of the present invention to provide a duplexer that can be realized with a very simple configuration, designed so as to substantially reduce a loss, and miniaturized easily, and a laminate-type high-frequency device and communication equipment using the duplexer. Furthermore, it is another object of the present invention to provide a duplexer that is improved so as to obtain a sufficient degree of design freedom, and a laminate-type high-frequency device and communication equipment using the duplexer.

In order to achieve the above-mentioned object, a first configuration of a duplexer of the present invention relates to a duplexer composed of a laminate in which dielectric layers and electrode layers are laminated alternately. The duplexer includes: a first filter for transmitting and a second filter for receiving, which are provided in the laminate and have different pass band frequencies; and a matching circuit composed of a coupling line, having one end that is short-circuited and the other end that is connected to an external terminal, provided between the first filter and the second filter. The first filter includes at least one first stripline resonator, having one end that is short-circuited. The second filter includes at least one second stripline resonator, having one end that is short-circuited, and the first stripline resonator and the second stripline resonator are coupled to the coupling line by electromagnetic field coupling.

In the first configuration of the duplexer, a duplexer can be realized with a simple configuration in which the first stripline resonator and the second stripline resonator are coupled to the coupling line by electromagnetic field coupling, without using lumped-constant elements such as an inductor and a capacitor. Therefore, a loss can be reduced substantially.

In the first configuration of the duplexer of the present invention, it is preferable that at least one of the first stripline resonator and the second stripline resonator has a large line width on an open end side and a small line width on a short-circuited side. According to this preferable example, the coupling degree between the first and second stripline resonators and the coupling line can be changed arbitrarily. Therefore, the degree of design freedom is enhanced substantially.

In the first configuration of the duplexer of the present invention, it is preferable that the laminate includes a first dielectric layer, a second dielectric layer, a third dielectric layer, and a fourth dielectric layer laminated successively. It also is preferable that the electrode layers include: a first shield electrode placed on an upper surface of the first dielectric layer; an interstage coupling capacitive electrode constituting the first filter and an input/output coupling capacitive electrode constituting the second filter, placed between the first dielectric layer and the second dielectric layer; a first resonator electrode constituting the first filter, a second resonator electrode constituting the second filter, and a coupling line electrode constituting the matching circuit, placed between the second dielectric layer and the third dielectric layer; an input/output coupling capacitive electrode constituting the first filter and an interstage coupling capacitive electrode constituting the second filter, placed between the third dielectric layer and the fourth dielectric layer; a second shield electrode placed on a lower surface of the fourth dielectric layer; at least three terminal electrodes connected to the input/output coupling capacitive electrode constituting the first filter, the input/output coupling capacitive electrode constituting the second filter, and the coupling line electrode, respectively, provided on side surfaces of the first dielectric layer, the second dielectric layer, the third dielectric layer, and the fourth dielectric layer; and an end face electrode connecting the first shield electrode and the second shield electrode to each other.

According to the above preferable example, a duplexer can be realized with a very simple configuration, so that a substantial reduction in loss and miniaturization can be achieved.

Furthermore, in this case, it is preferable that at least one of the first dielectric layer, the second dielectric layer, the third dielectric layer, and the fourth dielectric layer has a dielectric constant different from that of the other dielectric layers. According to this preferable example, the capacitance of a capacitor can be adjusted.

Furthermore, in this case, it is preferable that the duplexer further includes an adjusting capacitive electrode provided so as to be opposed to the first shield electrode with the first dielectric layer interposed therebetween. An antenna can be used for both transmitting and receiving. According to the preferable example, the matching between transmitting and receiving can be optimized.

In the first configuration of the duplexer of the present invention, at least one of the first stripline resonator and the second stripline resonator is formed on a dielectric layer different from a dielectric layer on which the coupling line is formed. According to this preferable example, the degree of design freedom and versatility can be enhanced.

In the first configuration of the duplexer of the present invention, it is preferable that the coupling line is composed of at least two striplines having different line widths, connected to each other. According to this preferable example, the strength of electromagnetic field coupling can be changed arbitrarily.

In the first configuration of the duplexer of the present invention, it is preferable that the coupling line is composed of a plurality of striplines, and the plurality of striplines are provided on different dielectric layers. According to this preferable example, an electric potential can be stabilized. Furthermore, in this case, it is preferable that at least one of the plurality of striplines has a line width different from that of the other striplines. According to this preferable example, stronger electromagnetic field coupling can be obtained. Furthermore, in this case, it is preferable that the plurality of striplines are connected to each other by a via hole. According to this preferable example, because of the shield effect of the via hole, the first stripline resonator and the second stripline resonator can be separated from each other. Therefore, a frequency component can be prevented from being transmitted to a receiving side during transmitting, and a frequency component can be prevented from being transmitted to a transmitting side during receiving.

In the first configuration of the duplexer of the present invention, it is preferable that the duplexer further includes a coupling capacitor provided so as to be overlapped with the coupling line and the stripline resonator with the dielectric layer interposed therebetween. According to this preferable example, the electric field coupling occurring due to a coupling capacitor is combined with electromagnetic field coupling occurring between the stripline resonator and the coupling line. In the coupling occurring between the stripline resonator and the coupling line, a magnetic field component is dominant. However, by providing the coupling capacitor, an electric field capacitance component can be increased.

In the first configuration of the duplexer of the present invention, it is preferable that the first filter and the second filter are provided so as to be opposed to each other with a shield electrode interposed therebetween. According to this preferable example, the first filter for transmitting and the second filter for receiving can be arranged in a vertical direction, so that the area occupied by the duplexer can be reduced.

Furthermore, in this case, it is preferable that the laminate includes a first dielectric layer, a second dielectric layer, a third dielectric layer, a fourth dielectric layer, a fifth dielectric layer, and a sixth dielectric layer laminated successively. It also is preferable that the electrode layers include: a first shield electrode placed on an upper surface of the first dielectric layer; an interstage coupling capacitive electrode and an input/output coupling capacitive electrode constituting the first filter, placed between the first dielectric layer and the second dielectric layer; a plurality of resonator electrodes constituting the first filter, placed between the second dielectric layer and the third dielectric layer; a third shield electrode and a coupling line electrode constituting the matching circuit, placed between the third dielectric layer and the fourth dielectric layer; a plurality of resonator electrodes and an input/output line electrode connected to the resonator electrodes constituting the second filter, placed between the fourth dielectric layer and the fifth dielectric layer; an interstage coupling capacitive electrode constituting the second filter, placed between the fifth dielectric layer and the sixth dielectric layer; a second shield electrode placed on a lower surface of the sixth dielectric layer; at least three terminal electrodes connected to the input/output coupling capacitive electrode, the input/output line electrode, and the coupling line electrode, respectively, provided on side surfaces of the first dielectric layer, the second dielectric layer, the third dielectric layer, the fourth dielectric layer, the fifth dielectric layer, and the sixth dielectric layer; and an end face electrode connecting the first shield electrode, the second shield electrode, and the third shield electrode to each other.

According to the above preferable example, the first filter and the second filter can be arranged in a vertical direction, so that the area occupied by the duplexer can be reduced.

A second configuration of a duplexer of the present invention relates to a duplexer composed of a laminate in which dielectric layers and electrode layers are laminated alternately. The duplexer includes: a first shield electrode, a second shield electrode, a third shield electrode, and a fourth shield electrode arranged in the laminate in a lamination direction; a first filter configured in such a manner that a plurality of stripline resonators, each having one end that is short-circuited, are adjacent to each other in parallel, placed between the first shield electrode and the second shield electrode; a matching circuit composed of a coupling line, placed between the second shield electrode and the third shield electrode; and a second filter that is configured in such a manner that a plurality of stripline resonators, each having one end that is short-circuited, are adjacent to each other in parallel and that has a pass band frequency different from that of the first filter, placed between the third shield electrode and the fourth shield electrode. The second and third shield electrodes are provided with coupling windows, and the stripline resonators constituting the first and second filters and the coupling line are coupled to each other by electromagnetic field coupling via the coupling windows, respectively.

According to the second configuration of the duplexer, the versatility of the strength of electromagnetic field coupling can be obtained easily.

In the second configuration of the duplexer of the present invention, it is preferable that the laminate includes a first dielectric layer, a second dielectric layer, a third dielectric layer, a fourth dielectric layer, a fifth dielectric layer, a sixth dielectric layer, a seventh dielectric layer, and an eighth dielectric layer laminated successively. It also is preferable that the electrode layers include: a first shield electrode placed on an upper surface of the first dielectric layer; an interstage coupling capacitive electrode and an input/output coupling capacitive electrode constituting the first filter, placed between the first dielectric layer and the second dielectric layer; a plurality of resonator electrodes constituting the first filter, placed between the second dielectric layer and the third dielectric layer; a third shield electrode partially provided with the coupling window, placed between the third dielectric layer and the fourth dielectric layer; a coupling line electrode constituting the matching circuit, placed between the fourth dielectric layer and the fifth dielectric layer; a fourth shield electrode partially provided with the coupling window, placed between the fifth dielectric layer and the sixth dielectric layer; a plurality of resonator electrodes and an input/output line electrode connected to the resonator electrodes constituting the second filter, placed between the sixth dielectric layer and the seventh dielectric layer; an interstage coupling capacitive electrode constituting the second filter, placed between the seventh dielectric layer and the eighth dielectric layer; a second shield electrode placed on a lower surface of the eighth dielectric layer; at least three terminal electrodes connected to the input/output coupling capacitive electrode, the input/output line electrode, and the coupling line electrode, respectively, provided on side surfaces of the first dielectric layer, the second dielectric layer, the third dielectric layer, the fourth dielectric layer, the fifth dielectric layer, the sixth dielectric layer, the seventh dielectric layer, and the eighth dielectric layer; and an end face electrode connecting the first shield electrode, the second shield electrode, the third shield electrode, and the fourth shield electrode to each other.

According to the above preferable example, a shield electrode is printed onto a dielectric layer, excluding a part thereof, whereby a coupling window is provided in the excluded part. Therefore, the strength of electromagnetic field coupling can be changed easily by such a simple method.

A third configuration of a duplexer of the present invention relates to a duplexer comprising a laminate in which dielectric layers and electrode layers are laminated alternately. The duplexer includes: a first filter for transmitting and a second filter for receiving, which are provided in the laminate and have different pass band frequencies; and a matching circuit composed of a coupling line, having one end that is opened and the other end that is connected to an external terminal, provided between the first filter and the second filter. The first filter includes at least one first stripline resonator, having one end that is short-circuited. The second filter includes at least one second stripline resonator, having one end that is short-circuited, and the first stripline resonator and the second stripline resonator are coupled to the coupling line by electromagnetic field coupling.

According to the third configuration of the duplexer, even by using a coupling line, having one end that is opened and the other end that is connected to an external terminal, a duplexer can be operated.

In the third configuration of the duplexer of the present invention, it is preferable that a matching capacitive electrode is connected to an open end side of the coupling line with a dielectric layer interposed therebetween. In the case where one end of the coupling line is opened, floating capacitance is generated in the open end, which causes variation. However, according to this preferable example, such variation can be stabilized. Furthermore, by changing a capacitance value, the degree of design freedom can be obtained.

In the third configuration of the duplexer of the present invention, it is preferable that at least one of the first stripline resonator and the second stripline resonator has a larger line width on an open end side and a smaller line width on a short-circuited end side.

In the third configuration of the duplexer of the present invention, it is preferable that the laminate includes a first dielectric layer, a second dielectric layer, a third dielectric layer, and a fourth dielectric layer laminated successively. It also is preferable that the electrode layers include: a first shield electrode placed on an upper surface of the first dielectric layer; an interstage coupling capacitive electrode constituting the first filter and an input/output coupling capacitive electrode constituting the second filter, placed between the first dielectric layer and the second dielectric layer; a first resonator electrode constituting the first filter, a second resonator electrode constituting the second filter, and a coupling line electrode constituting the matching circuit, placed between the second dielectric layer and the third dielectric layer; an input/output coupling capacitive electrode constituting the first filter and an interstage coupling capacitor electrode constituting the second filter, placed between the third dielectric layer and the fourth dielectric layer; a second shield electrode placed on a lower surface of the fourth dielectric layer; at least three terminal electrodes connected to the input/output coupling capacitive electrode constituting the first filter, the input/output coupling capacitive electrode constituting the second filter, and the coupling line electrode, respectively, provided on side surfaces of the first dielectric layer, the second dielectric layer, the third dielectric layer, and the fourth dielectric layer; and an end face electrode connecting the first shield electrode and the second shield electrode to each other.

Furthermore, in this case, it is preferable that at least one of the first dielectric layer, the second dielectric layer, the third dielectric layer, and the fourth dielectric layer has a dielectric constant different from that of the other dielectric layers.

Furthermore, in this case, it is preferable that the duplexer further includes an adjusting capacitive electrode provided so as to be opposed to the first shield electrode with the first dielectric layer interposed therebetween.

In the third configuration of the duplexer of the present invention, it is preferable that at least one of the first stripline resonator and the second stripline resonator is formed on a dielectric layer different from a dielectric layer on which the coupling line is formed.

In the third configuration of the duplexer of the present invention, it is preferable that the coupling line is composed of at least two striplines having different line widths, connected to each other.

In the third configuration of the duplexer of the present invention, it is preferable that the coupling line is composed of a plurality of striplines, and the plurality of striplines are provided on different dielectric layers. Furthermore, in this case, it is preferable that at least one of the plurality of striplines has a line width different from that of the other striplines. Furthermore, in this case, it is preferable that the plurality of striplines are connected to each other by a via hole.

In the third configuration of the duplexer of the present invention, it is preferable that the duplexer further includes a coupling capacitor provided so as to be overlapped with the coupling line and the stripline resonator with the dielectric layer interposed therebetween.

In the third configuration of the duplexer of the present invention, it is preferable that the first filter and the second filter are provided so as to be opposed to each other with a shield electrode interposed therebetween.

Furthermore, in this case, it is preferable that the laminate includes a first dielectric layer, a second dielectric layer, a third dielectric layer, a fourth dielectric layer, a fifth dielectric layer, and a sixth dielectric layer laminated successively. It also is preferable that the electrode layers include: a first shield electrode placed on an upper surface of the first dielectric layer; an interstage coupling capacitive electrode and an input/output coupling capacitive electrode constituting the first filter, placed between the first dielectric layer and the second dielectric layer; a plurality of resonator electrodes constituting the first filter, placed between the second dielectric layer and the third dielectric layer; a third shield electrode and a coupling line electrode constituting the matching circuit, placed between the third dielectric layer and the fourth dielectric layer; a plurality of resonator electrodes and an input/output line electrode connected to the resonator electrodes constituting the second filter, placed between the fourth dielectric layer and the fifth dielectric layer; an interstage coupling capacitive electrode constituting the second filter, placed between the fifth dielectric layer and the sixth dielectric layer; a second shield electrode placed on a lower surface of the sixth dielectric layer; at least three terminal electrodes connected to the input/output coupling capacitive electrode, the input/output line electrode, and the coupling line electrode, respectively, provided on side surfaces of the first dielectric layer, the second dielectric layer, the third dielectric layer, the fourth dielectric layer, the fifth dielectric layer, and the sixth dielectric layer; and an end face electrode connecting the first shield electrode, the second shield electrode, and the third shield electrode to each other.

A fourth configuration of the duplexer of the present invention relates to a duplexer composed of a laminate in which dielectric layers and electrode layers are laminated alternately. The duplexer includes: a first filter for transmitting and a second filter for receiving, which are provided in the laminate and have different pass band frequencies; and a matching circuit composed of a coupling line, provided between the first filter and the second filter. At least one of the first and second filters is a filter composed of a stripline resonator, having one end that is short-circuited, and a transmission line, having band elimination characteristics, and the transmission line and the coupling line are coupled to each other by electromagnetic field coupling.

According to the fourth configuration of the duplexer, the filter eliminates only a particular high-frequency component. In the filter having band elimination characteristics, a loss can be reduced, compared with a filter having band pass characteristics. Therefore, a loss of a transmitting filter can be reduced.

In the fourth configuration of the duplexer of the present invention, it is preferable that the laminate includes a first dielectric layer, a second dielectric layer, a third dielectric layer, a fourth dielectric layer, and a fifth dielectric layer laminated successively. It also is preferable that the electrode layers include: a first shield electrode placed on an upper surface of the first dielectric layer; an interstage coupling capacitive electrode constituting the first filter, placed between the first dielectric layer and the second dielectric layer; a plurality of resonator electrodes constituting the first filter and a coupling line electrode constituting the matching circuit, placed between the second dielectric layer and the third dielectric layer; an input/output coupling capacitive electrode constituting the first filter, a transmission line electrode constituting the second filter, having band elimination characteristics, and a coupling line electrode constituting a matching circuit, placed between the third dielectric layer and the fourth dielectric layer; a resonator electrode constituting the second filter, placed between the fourth dielectric layer and the fifth dielectric layer; a second shield electrode placed on a lower surface of the fifth dielectric layer; at least three terminal electrodes connected to the input/output coupling capacitive electrode, the transmission line electrode, and the coupling line electrode, respectively, provided on side surfaces of the first dielectric layer, the second dielectric layer, the third dielectric layer, the fourth dielectric layer, and the fifth dielectric layer; and an end face electrode connecting the first shield electrode and the second shield electrode to each other.

According to the above preferable example, because of the above-mentioned lamination configuration, a filter having band elimination characteristics can be formed easily.

In the fourth configuration of the duplexer of the present invention, it is preferable that the laminate includes a first dielectric layer, a second dielectric layer, a third dielectric layer, a fourth dielectric layer, and a fifth dielectric layer laminated successively. It also is preferable that the electrode layers include: a first shield electrode placed on an upper surface of the first dielectric layer; an interstage coupling capacitive electrode constituting the first filter, placed between the first dielectric layer and the second dielectric layer; a plurality of resonator electrodes constituting the first filter and a coupling line electrode constituting the matching circuit, placed between the second dielectric layer and the third dielectric layer; an input/output coupling capacitive electrode constituting the first filter and a transmission line electrode constituting the second filter, having band elimination characteristics, placed between the third dielectric layer and the fourth dielectric layer; a resonator electrode constituting the second filter, placed between the fourth dielectric layer and the fifth dielectric layer; a second shield electrode placed on a lower surface of the fifth dielectric layer; at least three terminal electrodes connected to the input/output coupling capacitive electrode, the transmission line electrode, and the coupling line electrode, respectively, provided on side surfaces of the first dielectric layer, the second dielectric layer, the third dielectric layer, the fourth dielectric layer, and the fifth dielectric layer; and an end face electrode connecting the first shield electrode and the second shield electrode to each other. It also is preferable that a part of the transmission line electrode is overlapped with the coupling line electrode with the third dielectric layer interposed therebetween in a projection in a lamination direction, and in the projection in the lamination direction, a width of the part of the transmission line electrode is the same as or different from that of the coupling line electrode.

According to the above preferable example, since the coupling line electrode and the transmission line electrode are placed in a vertical direction, electromagnetic field coupling becomes stronger. Furthermore, the width of a part of the transmission line electrode is set to be different from that of the coupling line electrode, whereby a margin can be provided with respect to a shift in overlapping during lamination.

A laminate-type high-frequency device of the present invention includes: a duplexer composed of a laminate in which dielectric layers and electrode layers are laminated alternately; and a semiconductor chip and/or a surface acoustic wave device mounted on an upper surface of the laminate. The duplexer of the present invention is used as the duplexer.

According to the configuration of the laminate-type high-frequency device, since a duplexer can be realized with a very simple configuration, a laminate-type high-frequency device, in which a loss can be reduced substantially and which is provided with a semiconductor chip and/or a surface acoustic wave device, can be obtained.

Communication equipment of the present invention includes: an antenna; and a duplexer for transmitting a frequency component output from a transmitting circuit to the antenna and transmitting a frequency component received from the antenna to a receiving circuit, composed of a laminate in which dielectric layers and electrode layers are laminated alternately. The duplexer of the present invention is used as the duplexer.

According to the configuration of the communication equipment, a duplexer can be realized with a very simple configuration. Therefore, communication equipment in which a loss can be reduced substantially can be obtained.

In the configuration of the communication equipment of the present invention, it is preferable that the communication equipment further includes at least one selected from a semiconductor chip and a surface acoustic wave device mounted on an upper surface of the laminate. According to this preferable example, communication equipment can be obtained that includes a laminate-type high-frequency device in which a loss can be reduced substantially and has a semiconductor chip and/or a surface acoustic wave device.

According to the present invention, it is possible to obtain a duplexer that can be realized with a very simple configuration, designed so as to substantially reduce a loss, and miniaturized easily, and a laminate-type high-frequency device and communication equipment using the duplexer. Furthermore, according to the present invention, it is possible to obtain a duplexer that is improved so as to obtain a sufficient degree of design freedom, and a laminate-type high-frequency device and communication equipment using the duplexer.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described in detail by way of illustrative embodiments with reference to the drawings.

Figure 1:
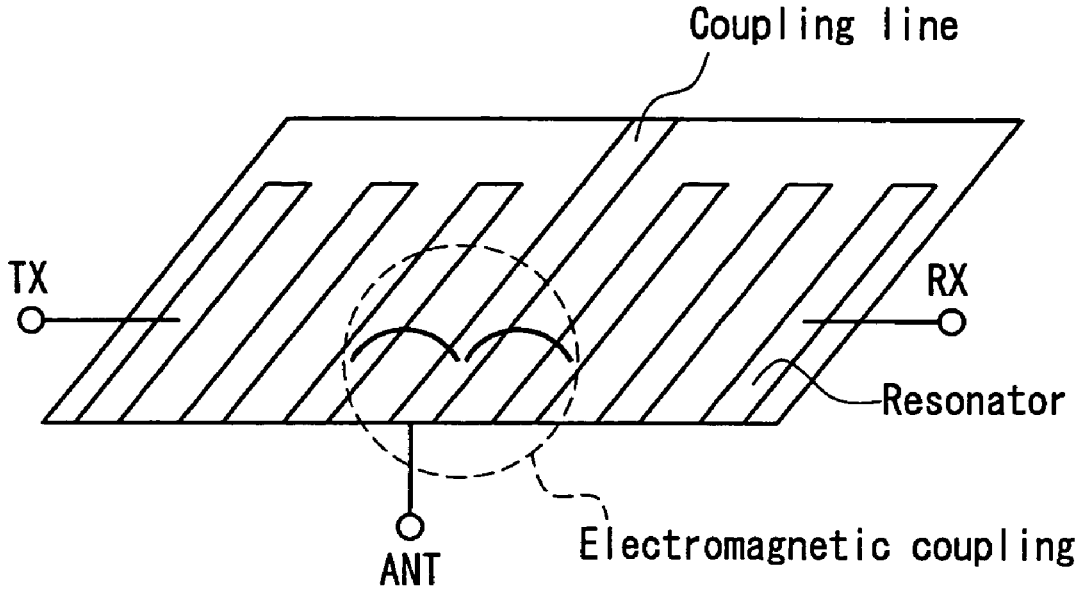
FIG. 1 is a schematic view showing a duplexer according to an embodiment of the present invention.

FIG. 1 is a schematic view showing a duplexer according to an embodiment of the present invention. As shown in FIG. 1, in the duplexer according to the present embodiment, resonators and a coupling line are provided integrally in a dielectric substrate. Two filters for transmitting and receiving are configured in a triplet shape. A matching circuit composed of a coupling line is provided between the transmitting filter and the receiving filter. The coupling line is connected to an antenna terminal (ANT). The transmitting filter is connected to a terminal (TX) of a transmitting circuit, and the receiving filter is connected to a terminal (RX) of a receiving circuit. The coupling line is coupled directly to the resonators of the transmitting filter and the receiving filter, closest to the coupling line, by electromagnetic field coupling (M). More specifically, the coupling line is coupled to the resonators of the transmitting and receiving filters in terms of high frequencies by the combination of magnetic coupling and electric field coupling, whereby desired duplexer characteristics are realized. Thus, according to the present embodiment, a duplexer can be realized with a very simple configuration, so that a loss can be reduced substantially.

Embodiment 1

Figure 2:
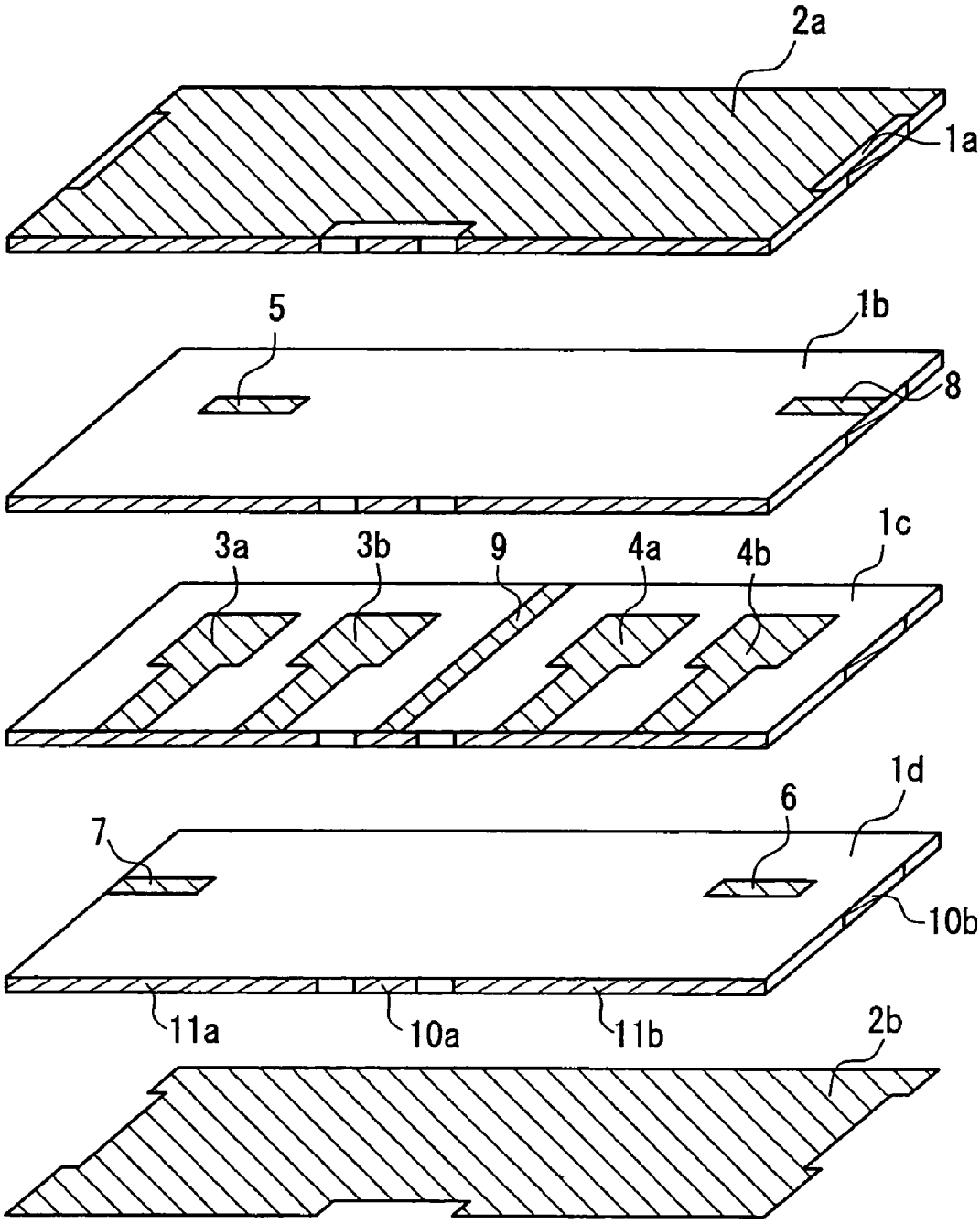
FIG. 2 is an exploded perspective view showing a duplexer according to Embodiment 1 of the present invention.

FIG. 2 is an exploded perspective view showing a duplexer according to Embodiment 1 of the present invention.

As shown in FIG. 2, the duplexer according to the present embodiment is composed of a laminate in which dielectric layers and electrode layers are laminated alternately. In the laminate, a first filter for transmitting and a second filter for receiving, having different pass band frequencies, are provided. Furthermore, a matching circuit composed of a coupling line 9, having one end that is short-circuited and the other end that is connected to an external terminal, is provided between the first filter and the second filter.

The first filter includes two first stripline resonators 3*a* and 3*b*, each having one end that is short-circuited. The second filter includes two second stripline resonators 4*a* and 4*b*, each having one end that is short-circuited. The coupling line 9 is coupled to the first stripline resonator 3*b* close to the coupling line 9 by electromagnetic field coupling. The coupling line 9 is coupled to the second stripline resonator 4*a* dose to the coupling line 9 by electromagnetic field coupling.

In the present embodiment, the first stripline resonators 3*a*, 3*b* and the second stripline resonators 4*a*, 4*b* have a large line width (wide portion) on the open end side and a small line width (narrow portion) on the short-circuited end side. Thus, by adopting a configuration in which the line width of the stripline resonators is varied between the open end side and the short-circuited end side, the coupling degree between the first and second stripline resonators 3*b*, 4*a* and the coupling line 9 can be varied arbitrarily, whereby the degree of design freedom is enhanced greatly.

Next, an actual configuration of the duplexer according to the present embodiment will be described in detail.

The laminate includes a first dielectric layer 1*a*, a second dielectric layer 1*b*, a third dielectric layer 1*c*, and a fourth dielectric layer 1*d* laminated successively. Herein, each dielectric layer may be made of glass ceramic.

The electrode layer has the following configuration. A first shield electrode 2*a* is placed on an upper surface of the first dielectric layer 1*a*. An interstage coupling capacitive electrode 5 constituting the first filter and an input/output coupling capacitive electrode 8 constituting the second filter are placed between the first dielectric layer 1*a* and the second dielectric layer 1*b*. First resonator electrodes first stripline resonators) 3*a*, 3*b* constituting the first filter, second resonator electrodes (second stripline resonators) 4*a*, 4*b* constituting the second filter, and the coupling line electrode (coupling line) 9 are placed between the second dielectric layer 1*b* and the third dielectric layer 1*c*. The input/output coupling capacitive electrode 7 constituting the first filter and the interstage coupling capacitive electrode 6 constituting the second filter are placed between the third dielectric layer 1*c* and the fourth dielectric layer 1*d*. A second shield electrode 2*b* is placed on a lower surface of the fourth dielectric layer 1*d*. At least three terminal electrodes (external terminals) 10*a*, 10*b* (terminal electrodes (external terminals) corresponding to the input/output coupling capacitive electrode 7 are not shown) connected to the input/output coupling capacitive electrodes 7, 8 and the coupling line electrode 9 are provided on side surfaces of the first dielectric layer 1*a*, the second dielectric layer 1*b*, the third dielectric layer 1*c*, and the fourth dielectric layer 1*d*. The first shield electrode 2*a* and the second shield electrode 2*b* are connected by end face electrodes 11*a* and 11*b*. Herein, each electrode may be made of a conductive material mainly containing silver.

According to the configuration of the present embodiment, a duplexer can be realized with a very simple configuration in which the first resonator electrode 3*b* and the second resonator electrode 4*a* are coupled to the coupling line electrode 9 by electromagnetic field coupling without using lumped-constant elements such as an inductor and a capacitor. Therefore, a loss can be reduced substantially.

In the duplexer according to the present embodiment, it is desirable that at least one of the first dielectric layer 1*a*, the second dielectric layer 1*b*, the third dielectric layer 1*c*, and the fourth dielectric layer 1*d* has a dielectric constant different from those of the other dielectric layers. The dielectric constant can be adjusted by varying the composition of glass ceramic. Thus, by setting the dielectric constant of at least one of a plurality of dielectric layers to be different from those of the other dielectric layers, the capacitance of a capacitor can be adjusted.

Figure 3:
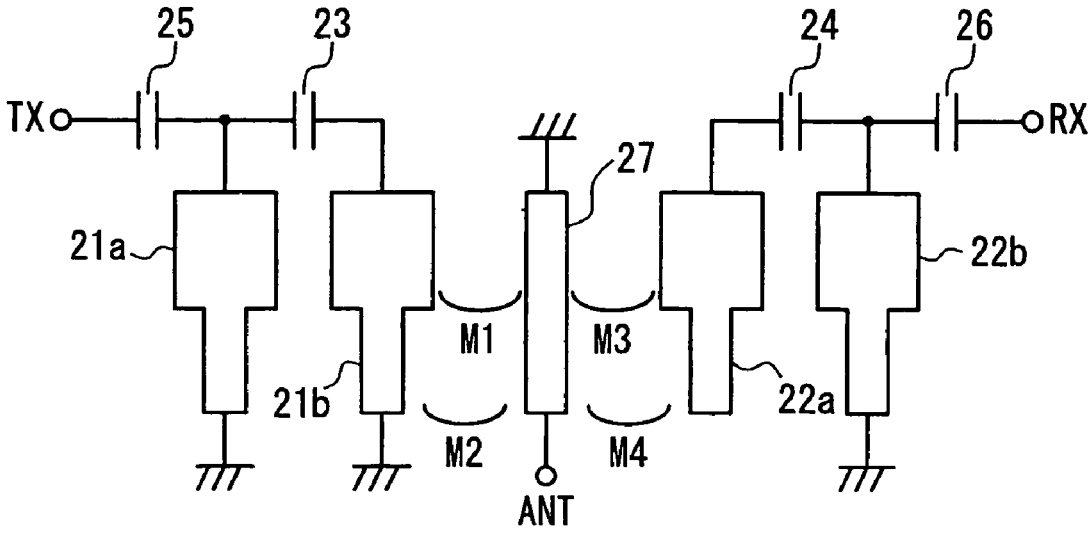
FIG. 3 is an equivalent circuit diagram of the duplexer according to Embodiment 1 of the present invention.

FIG. 3 shows an equivalent circuit of the duplexer having the above-mentioned configuration. As shown in FIG. 3, the duplexer according to the present embodiment includes interstage coupling capacitors 23, 24, input/output coupling capacitors 25, 26, a coupling line 27, and resonators 21*a*, 21*b*, 22*a*, and 22*b*. Herein, the coupling line 27 is coupled to a wide portion of the resonator 21*b* close to the coupling line 27 by electromagnetic field coupling M1. The coupling line 27 is coupled to a narrow portion of the resonator 21*b* by electromagnetic field coupling M2. The coupling line 27 is coupled to a wide portion of the resonator 22*a* dose to the coupling line 27 by electromagnetic field coupling M3. Furthermore, the coupling line 27 is coupled to a narrow portion of the resonator 22*a* by electromagnetic field coupling M4.

Figure 4:
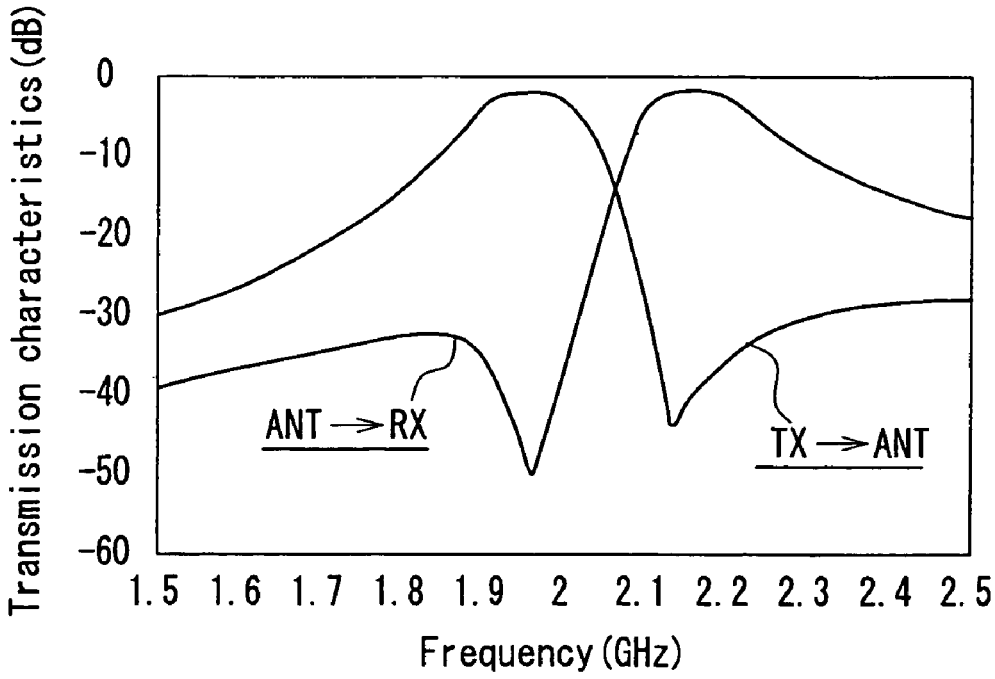
FIG. 4 shows transmission characteristics of the duplexer according to Embodiment 1 of the present invention.
Figure 5:
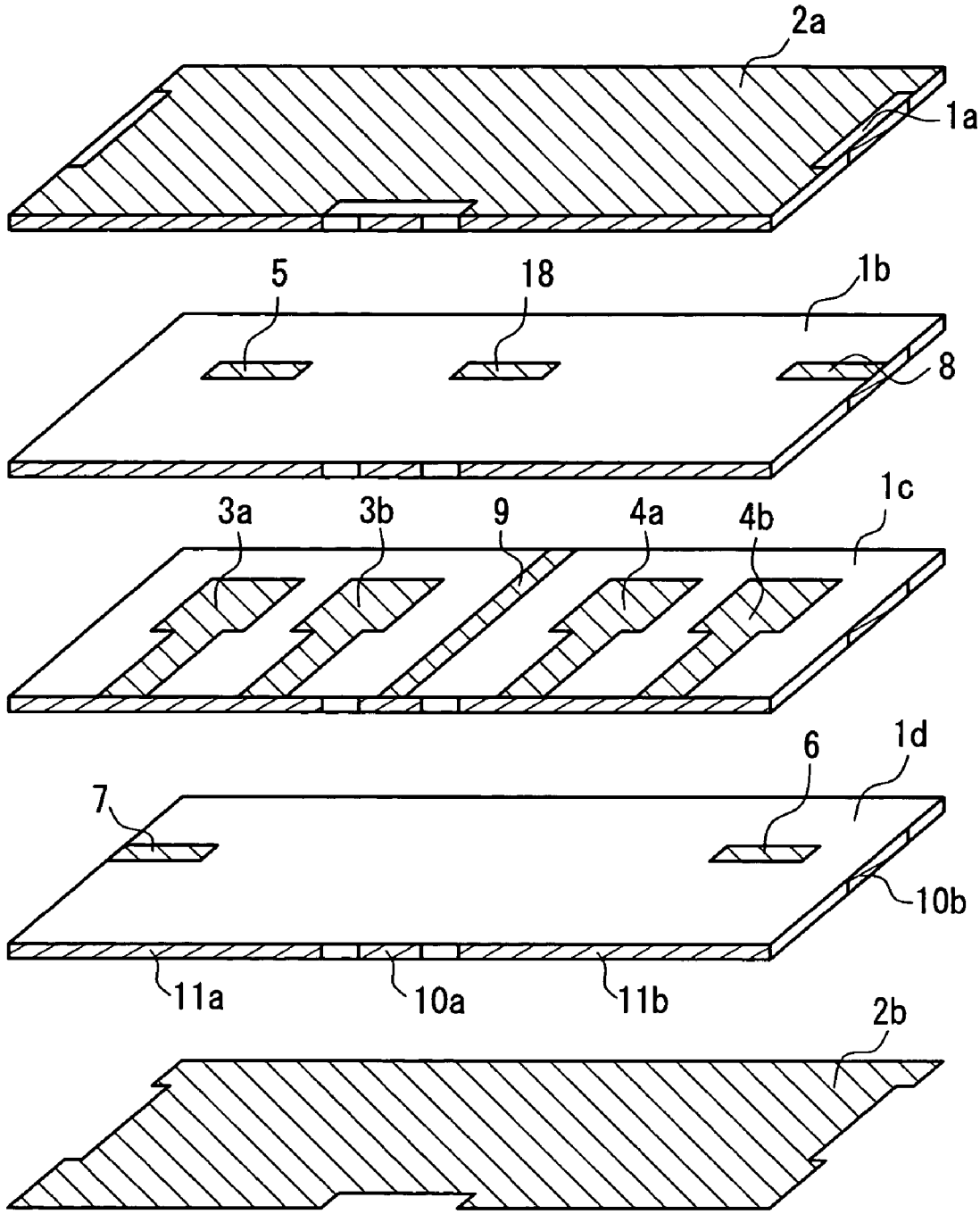
FIG. 5 is an exploded perspective view showing another example of a duplexer according to the embodiment of the present invention.

FIG. 4 shows the transmission characteristics of a duplexer having the above-mentioned configuration. In FIG. 4, TX→ANT represents the characteristics of the transmitting filter, and ANT→RX represents the characteristics of the receiving filter. As shown in FIG. 4, it is understood that the duplexer according to the present embodiment transmits only a required frequency component and does not transmit an unnecessary frequency component during transmitting. Furthermore, it is understood that the duplexer according to the present embodiment transmits only a required frequency component and does not transmit an unnecessary frequency component during receiving. Thus, if the duplexer according to the present embodiment is used, a frequency component can be prevented from being transmitted to a receiving side during transmitting, and a frequency component can be prevented from being transmitted to the transmitting side during receiving.

As a variation of the present embodiment, it also is desirable that a coupling capacitor 18 is provided so as to be overlapped with the coupling line 9 and the stripline resonators 3*b*, 4*a* via the dielectric layer 1*b*. According to this configuration, the electric field coupling occurring due to the coupling capacitor 18 is combined with the electromagnetic field coupling occurring between the stripline resonators 3*b*, 4*a* and the coupling line 9. In the electromagnetic field coupling occurring between the stripline resonators 3*b*, 4*a* and the coupling line 9, a magnetic field component is dominant; however, an electric field capacitive component can be increased by providing the coupling capacitor 18.

In the present embodiment, the first filter is configured so as to include the first stripline resonators 3*a*, 3*b*, each having one end that is short-circuited, and the second filter is configured so as to include the second stripline resonators 4*a*, 4*b*, each having one end that is short-circuited. However, the present invention is not limited thereto. The first filter may include at least one first stripline resonator, having one end that is short-circuited, and the second filter may include at least one second stripline resonator, having one end that is short-circuited.

Furthermore, in the present embodiment, the first stripline resonators 3*a*, 3*b* and the second stripline resonators 4*a*, 4*b* are configured so as to have a large line width on an open end side and a small line width on a short-circuited side. However, the present invention is not limited thereto. At least one of the first and second stripline resonators may have a large line width on the open end side and a small line width on the short-circuited end side.

Embodiment 2

Figure 6:
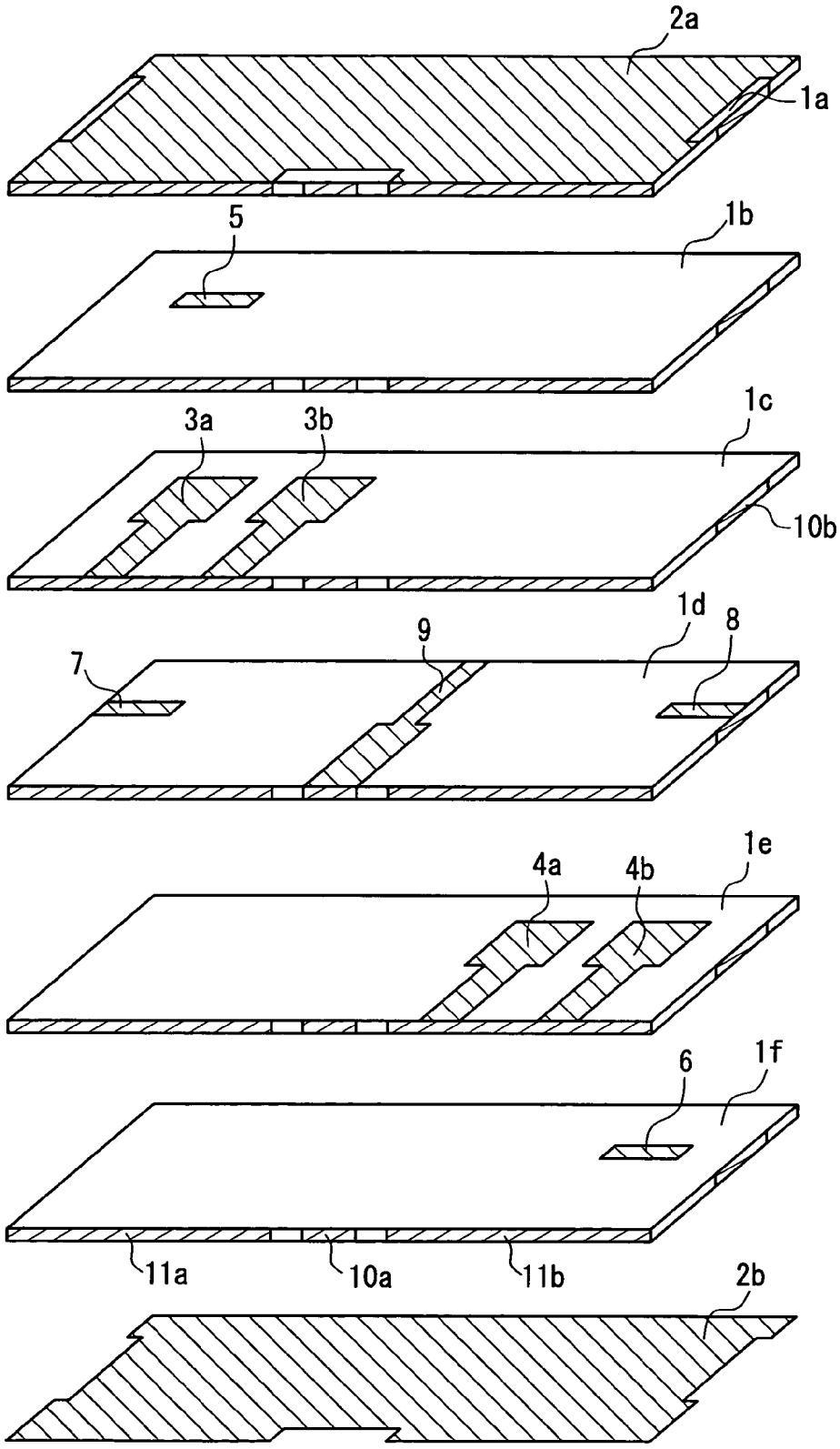
FIG. 6 is an exploded perspective view showing a duplexer according to Embodiment 2 of the present invention.

FIG. 6 is an exploded perspective view showing a duplexer according to Embodiment 2 of the present invention. The duplexer according to the present embodiment is the same as that according to Embodiment 1 except for the points described below. Therefore, like components are denoted with like numerals, and their description will be omitted here.

As shown in FIG. 6, in the duplexer according to the present embodiment, the first stripline resonators 3*a*, 3*b* and the second stripline resonators 4*a*, 4*b* are formed on dielectric layers 1*c*, 1*e*, different from the dielectric layer 1*d* on which the coupling line 9 is formed. Thus, by forming the first stripline resonators 3*a*, 3*b* and the second stripline resonators 4*a*, 4*b* on the dielectric layers 1*c*, 1*e* different from the dielectric layer 1*d* on which the coupling line 9 is formed, the degree of design freedom and versatility can be provided.

Furthermore, the coupling line 9 is composed of two striplines (wide portion and narrow portion) having different line widths and connected to each other. Thus, by configuring the coupling line 9 with two striplines having different line widths, the strength of electromagnetic field coupling can be varied arbitrarily.

In the present embodiment, the first stripline resonators 3*a*, 3*b* and the second stripline resonators 4*a*, 4*b* are formed on the dielectric layers 1*c*, 1*e* different from the dielectric layer 1*d* on which the coupling line 9 is formed. However, the present invention is not limited thereto. At least one of the first stripline resonator and the second stripline resonator may be formed on a dielectric layer different from a dielectric layer on which a coupling line is formed.

Furthermore, in the present embodiment, although the coupling line 9 is composed of two striplines having different line widths connected to each other, the present invention is not limited thereto. The coupling line may be composed of three or more striplines having different line widths connected to each other.

Embodiment 3

Figure 7:
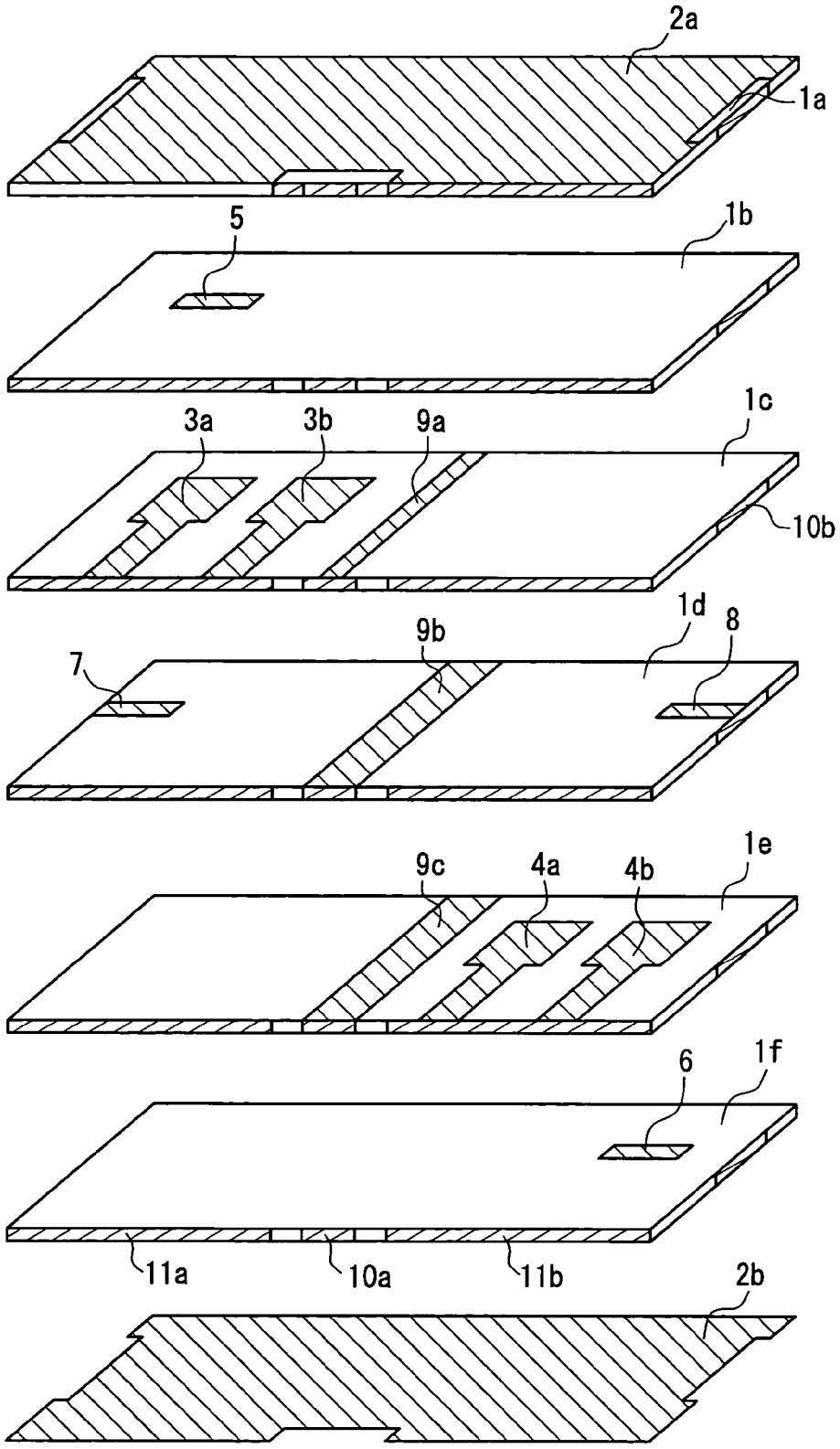
FIG. 7 is an exploded perspective view showing a duplexer according to Embodiment 3 of the present invention.

FIG. 7 is an exploded perspective view showing a duplexer according to Embodiment 3 of the present invention. The duplexer according to the present embodiment is the same as that according to Embodiment 2 except for the points described below. Therefore, like components are denoted with like numerals, and their description will be omitted here.

As shown in FIG. 7, in the duplexer according to the present embodiment, the coupling line is composed of three striplines 9*a*, 9*b*, and 9*c*, and the three striplines 9*a*, 9*b*, and 9*c* are provided on different dielectric layers 1*c*, 1*d*, and 1*e*, respectively. In the case where there is only one stripline, an electric potential is fluctuated. However, by using three striplines, the electric potential can be stabilized.

It is desirable that at least one of the three striplines 9*a*, 9*b*, and 9*c* has a line width different from those of the others. In the present embodiment, all the striplines 9*a*, 9*b*, and 9*c* are configured so as to have different line widths. The electromagnetic field coupling is varied depending upon the line width of a connecting line. Therefore, by varying the line width of the coupling line, stronger electromagnetic field coupling can be obtained.

In the present embodiment, although the coupling line is composed of three striplines 9*a*, 9*b*, and 9*c*, the present invention is not limited thereto. The coupling line may be composed of a plurality of striplines.

Embodiment 4

Figure 8:
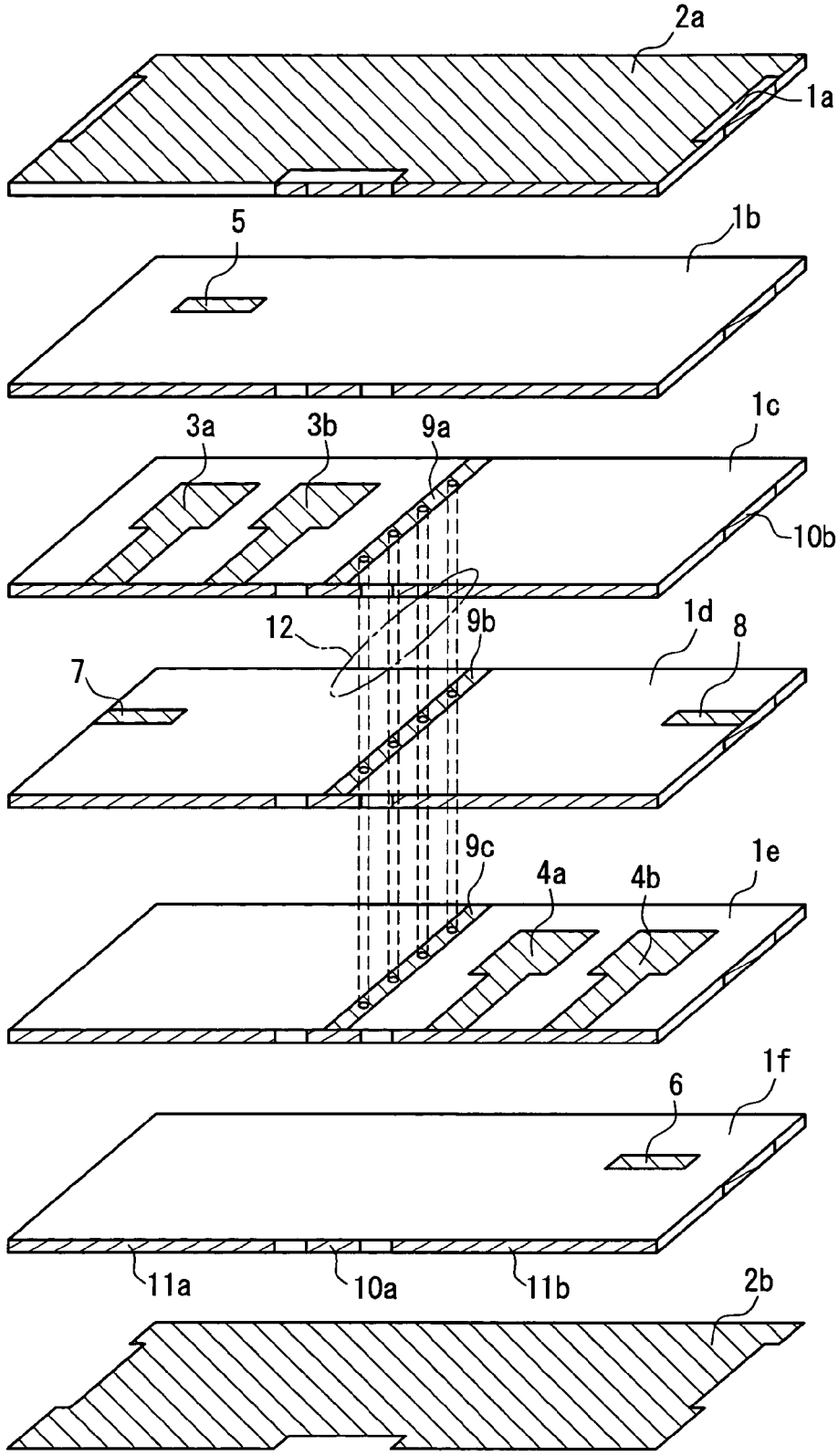
FIG. 8 is an exploded perspective view showing a duplexer according to Embodiment 4 of the present invention.

FIG. 8 is an exploded perspective view showing a duplexer according to Embodiment 4 of the present invention. The duplexer according to the present embodiment is the same as that according to Embodiment 3 except for the points described below. Therefore, like components are denoted with like numerals, and their description will be omitted here.

As shown in FIG. 8, in the duplexer according to the present embodiment, three striplines 9*a*, 9*b*, and 9*c* are connected to each other through a via hole 12.

According to the configuration of the present embodiment, because of the shield effect of the via hole 12, the first stripline resonators 3*a*, 3*b* can be separated from the second stripline resonators 4*a*, 4*b*. Therefore, a frequency component can be prevented from being transmitted to a receiving side during transmitting, and a frequency component can be prevented from being transmitted to a transmitting side during receiving.

Embodiment 5

Figure 9:
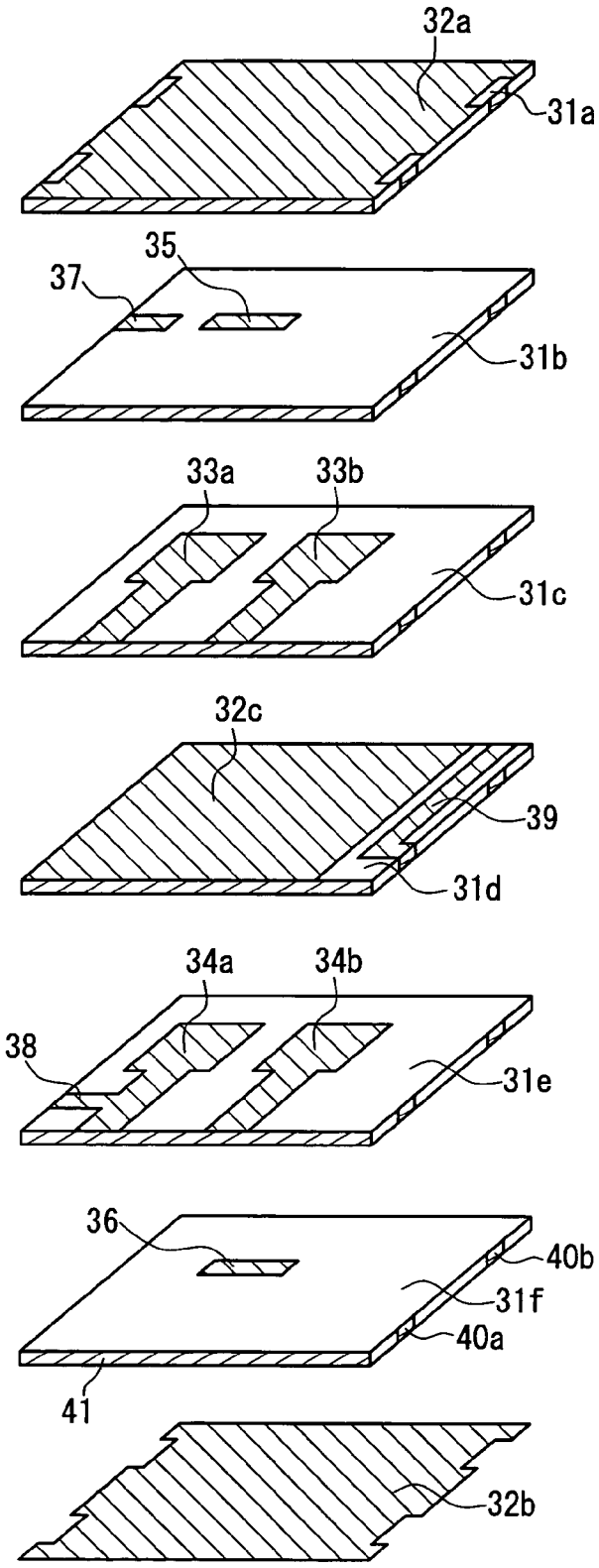
FIG. 9 is an exploded perspective view showing a duplexer according to Embodiment 5 of the present invention.

FIG. 9 is an exploded perspective view showing a duplexer according to Embodiment 5 of the present invention.

As shown in FIG. 9, the duplexer according to the present embodiment is composed of a laminate in which dielectric layers and electrode layers are laminated alternately. In the laminate, a first filter for transmitting and a second filter for receiving, having different pass band frequencies, are provided so as to be opposed to each other with a third shield electrode 32*c* interposed therebetween. Furthermore, a matching circuit composed of a coupling line 39, having one end that is short-circuited and the other end that is connected to an external terminal, is provided between the first filter and the second filter.

The first filter includes two first stripline resonators 33*a* and 33*b*, each having one end that is short-circuited. Furthermore, the second filter includes two second stripline resonators 34*a* and 34*b*, each having one end that is short-circuited. The coupling line 39 is connected to the first stripline resonator 33*b* by electromagnetic field coupling. The coupling line 39 is coupled to the second stripline resonator 34*b* by electromagnetic field coupling.

Next, an actual configuration of the duplexer according to the present embodiment will be described in detail.

The laminate includes a first dielectric layer 31*a*, a second dielectric layer 31*b*, a third dielectric layer 31*c*, a fourth dielectric layer 31*d*, a fifth dielectric layer 31*e*, and a sixth dielectric layer 31*f* laminated successively.

The electrode layer has the following configuration. A first shield electrode 32*a* is placed on an upper surface of the first dielectric layer 31*a*. An interstage coupling capacitive electrode 35 and an input/output coupling capacitive electrode 37, constituting the first filter, are placed between the first dielectric layer 31*a* and the second dielectric layer 31*b*. The first resonator electrodes (first stripline resonators) 33*a* and 33*b* constituting the first filter are placed between the second dielectric layer 31*b* and the third dielectric layer 31*c*. The third shield electrode 32*c* and the coupling line electrode 39 constituting the matching circuit are placed between the third dielectric layer 31*c* and the fourth dielectric layer 31*d*. The second resonator electrodes (second stripline resonators) 34*a*, 34*b* and the input/output line electrode 38 connected to the resonator electrode 34*a*, constituting the second filter, are placed between the fourth dielectric layer 31*d* and the fifth dielectric layer 31*e*. The interstage coupling capacitive electrode 36 constituting the second filter is placed between the fifth dielectric layer 31*e* and the sixth dielectric layer 31*f*. The second shield electrode 32*b* is placed on a lower surface of the sixth dielectric layer 31*f*. At least three terminal electrodes 40*a*, 40*b* (terminal electrodes corresponding to the input/output coupling capacitive electrode 37 and the input/output line electrode 38 are not shown) connected to the input/output coupling capacitive electrode 37, the input/output line electrode 38, and the coupling line electrode 39, respectively, are provided on side surfaces of the first dielectric layer 31*a*, the second dielectric layer 31*b*, the third dielectric layer 31*c*, the fourth dielectric layer 31*d*, the fifth dielectric layer 31*e*, and the sixth dielectric layer 31*f*. The first shield electrode 32*a*, the second shield electrode 32*b*, and the third shield electrode 32*c* are connected by an end face electrode 41.

According to the configuration of the present embodiment, the first filter for transmitting and the second filter for receiving can be arranged in a vertical direction (lamination direction), so that the area occupied by the duplexer can be decreased. The duplexer of the present embodiment has a laminated configuration, which enables vertical arrangement.

In the present embodiment, the first filter is configured so as to include two first stripline resonators 33*a* and 33*b*, each having one end that is short-circuited, and the second filter is configured so as to include two second stripline resonators 34*a* and 34*b*, each having one end that is short-circuited. However, the present invention is not limited thereto. The first filter may include three or more first stripline resonators, each having one end that is short-circuited, and the second filter may include three or more second stripline resonators, each having one end that is short-circuited.

Embodiment 6

Figure 10:
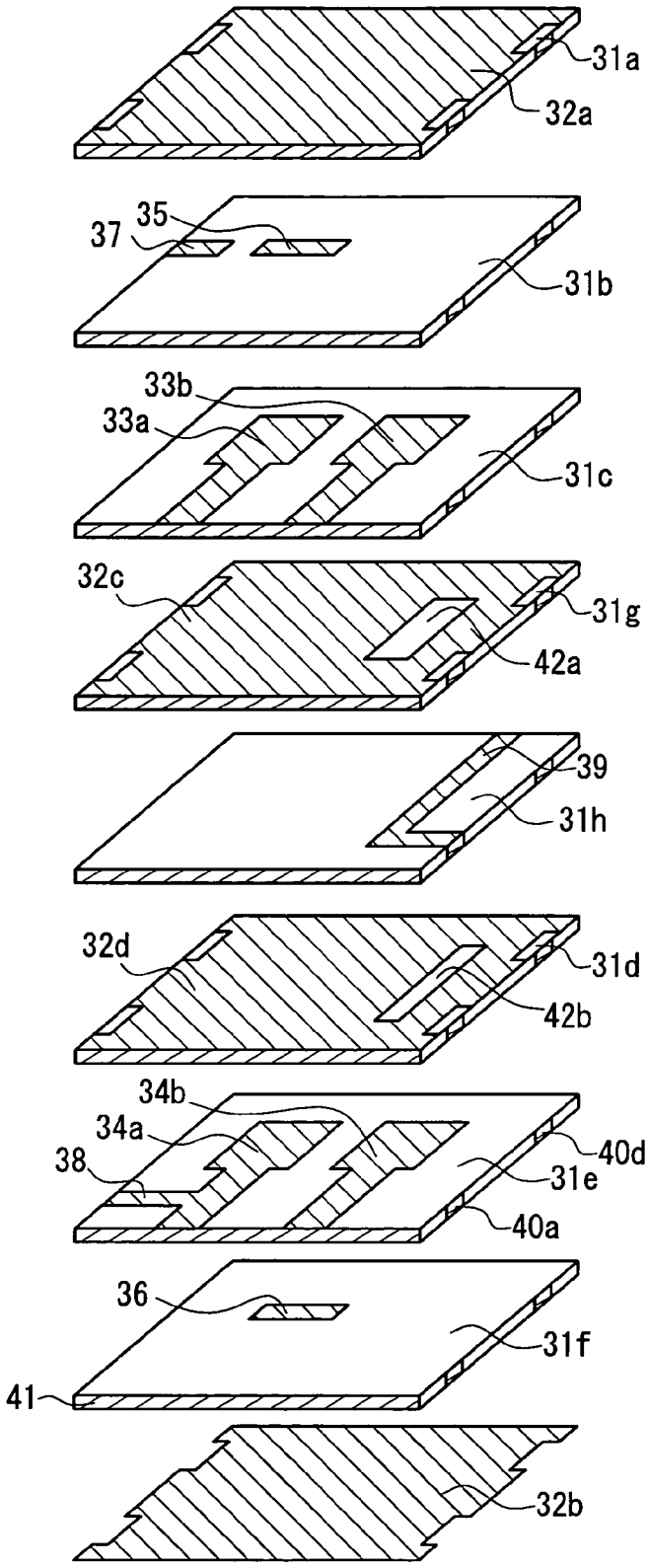
FIG. 10 is an exploded perspective view showing a duplexer according to Embodiment 6 of the present invention.

FIG. 10 is an exploded perspective view showing a duplexer according to Embodiment 6 of the present invention.

As shown in FIG. 10, the duplexer according to the present embodiment is composed of a laminate in which dielectric layers and electrode layers are laminated alternately. In the laminate, a first shield electrode 32*a*, a third shield electrode 32*c*, a fourth shield electrode 32*d*, and a second shield electrode 32*b* are arranged in a lamination direction. A first filter is provided between the first shield electrode 32*a* and the third shield electrode 32*c*. In the first filter, two first stripline resonators 33*a* and 33*b*, each having one end that is short-circuited, are arranged in parallel so as to be close to each other. A matching circuit composed of a coupling line 39, having one end that is short-circuited and the other end that is connected to an external terminal, is provided between the third shield electrode 32*c* and the fourth shield electrode 32*d*. A second filter is provided between the fourth shield electrode 32*d* and the second shield electrode 32*b*. In the second filter, two second stripline resonators 34*a* and 34*b*, each having one end that is short-circuited, are arranged in parallel so as to be close to each other. The second filter has a different pass band frequency from that of the first filter. Coupling windows 42*a* and 42*b* are provided in the third shield electrode 32*c* and the fourth shield electrode 32*d*, respectively. The first stripline resonator 33*b* constituting the first filter and the coupling line 39 are coupled to each other by electromagnetic field coupling via the coupling window 42*a*. Furthermore, the second stripline resonator 34*b* constituting the second filter and the coupling line 39 are coupled to each other by electromagnetic field coupling via the coupling window 42*b*.

In the coupling windows 42*a* and 42*b*, shield electrodes are not printed. By providing the coupling windows 42*a* and 42*b*, the versatility of the strength of electromagnetic field coupling can be obtained easily.

Next, an actual configuration of the duplexer according to the present embodiment will be described in detail.

The laminate includes a first dielectric layer 31*a*, a second dielectric layer 31*b*, a third dielectric layer 31*c*, a fourth dielectric layer 31*g*, a fifth dielectric layer 31*h*, a six dielectric layer 31*d*, a seventh dielectric layer 31*e*, and an eighth dielectric layer 31*f* laminated successively.

The electrode layer has the following configuration. The first shield electrode 32*a* is placed on an upper surface of the first dielectric layer 31*a*. An interstage coupling capacitive electrode 35 and an input/output coupling capacitive electrode 37, constituting the first filter, are placed between the first dielectric layer 31*a* and the second dielectric layer 31*b*. The first resonator electrodes (first stripline resonators) 33*a* and 33*b* constituting the first filter are placed between the second dielectric layer 31*b* and the third dielectric layer 31*c*. The third shield electrode 32*c* partially provided with the coupling window 42*a* is placed between the third dielectric layer 31*c* and the fourth dielectric layer 31*g*. The coupling line electrode 39 constituting the matching circuit, having one end that is short-circuited and the other end that is connected to an external terminal, is placed between the fourth dielectric layer 31*g* and the fifth dielectric layer 31*h*. The fourth shield electrode 32*d* partially provided with the coupling window 42*b* is placed between the fifth dielectric layer 31*h* and the sixth dielectric layer 31*d*. The second resonator electrodes (second stripline resonators) 34*a*, 34*b* and the input/output line electrode 38 connected to the second resonator electrode 34*a*, constituting the second filter, are placed between the sixth dielectric layer 31*d* and the seventh dielectric layer 31*e*. Furthermore, the interstage coupling capacitive electrode 36 constituting the second filter is placed between the seventh dielectric layer 31*e* and the eighth dielectric layer 31*f* The second shield electrode 32*b* is placed on a lower surface of the eighth dielectric layer 31*f*. At least three terminal electrodes 40*a*, 40*b* (terminal electrodes corresponding to the input/output coupling capacitive electrode 37 and the input/output line electrode 38 are not shown) connected to the input/output coupling capacitive electrode 37, the input/output line electrode 38, and the coupling line electrode 39, respectively, are provided on side surfaces of the first dielectric layer 31*a*, the second dielectric layer 31*b*, the third dielectric layer 31*c*, the fourth dielectric layer 31*g*, the fifth dielectric layer 31*h*, the sixth dielectric layer 31*d*, the seventh dielectric layer 31*e*, and the eighth dielectric layer 31*f*. The first shield electrode 32*a*, the third shield electrode 32*c*, the fourth shield electrode 32*d*, and the second shield electrode 32*b* are connected by an end face electrode 41.

According to the configuration of the present embodiment, the shield electrodes are printed onto the dielectric layers, excluding a part thereof, whereby coupling windows 42*a* and 42*b* are provided. Thus, the strength of electromagnetic field coupling can be changed easily by such a simple method.

Figure 11:
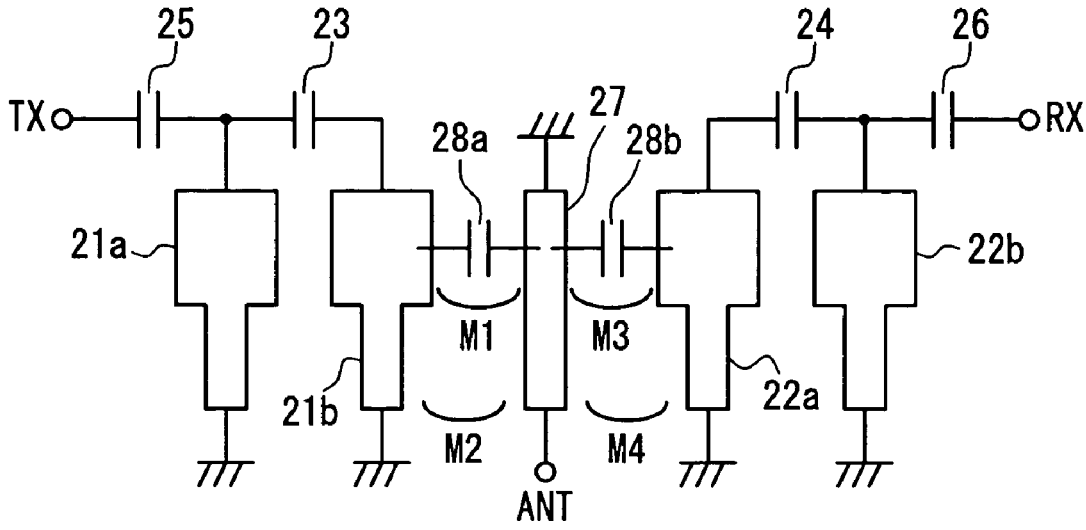
FIG. 11 is an equivalent circuit diagram of the duplexer according to Embodiment 6 of the present invention.

FIG. 11 shows an equivalent circuit of a duplexer having the above-mentioned configuration. The equivalent circuit of the duplexer in the present embodiment is the same as that shown in FIG. 3 except for the following points. Therefore, like components are denoted with like reference numerals, and their description will be omitted here.

The equivalent circuit of the duplexer in the present embodiment is different from that shown in FIG. 3 in that a coupling capacitor 28*a* is provided so as to be overlapped with the coupling line 27 and the stripline resonator 21*b* with a dielectric layer interposed therebetween, and a coupling capacitor 28*b* is provided so as to be overlapped with the coupling line 27 and the stripline resonator 22*a* with a dielectric layer interposed therebetween. Because of this, the electric field coupling occurring due to the coupling capacitors 28*a* and 28*b* is combined with the electromagnetic field coupling occurring between the stripline resonators 22*a*, 21*b* and the coupling line 27. In the electromagnetic field coupling occurring between the stripline resonators 22*a*, 21*b* and the coupling line 27, a magnetic field component is dominant; however, an electric field capacitive component can be increased by providing the coupling capacitors 28*a* and 28*b*.

Embodiment 7

Figure 12:
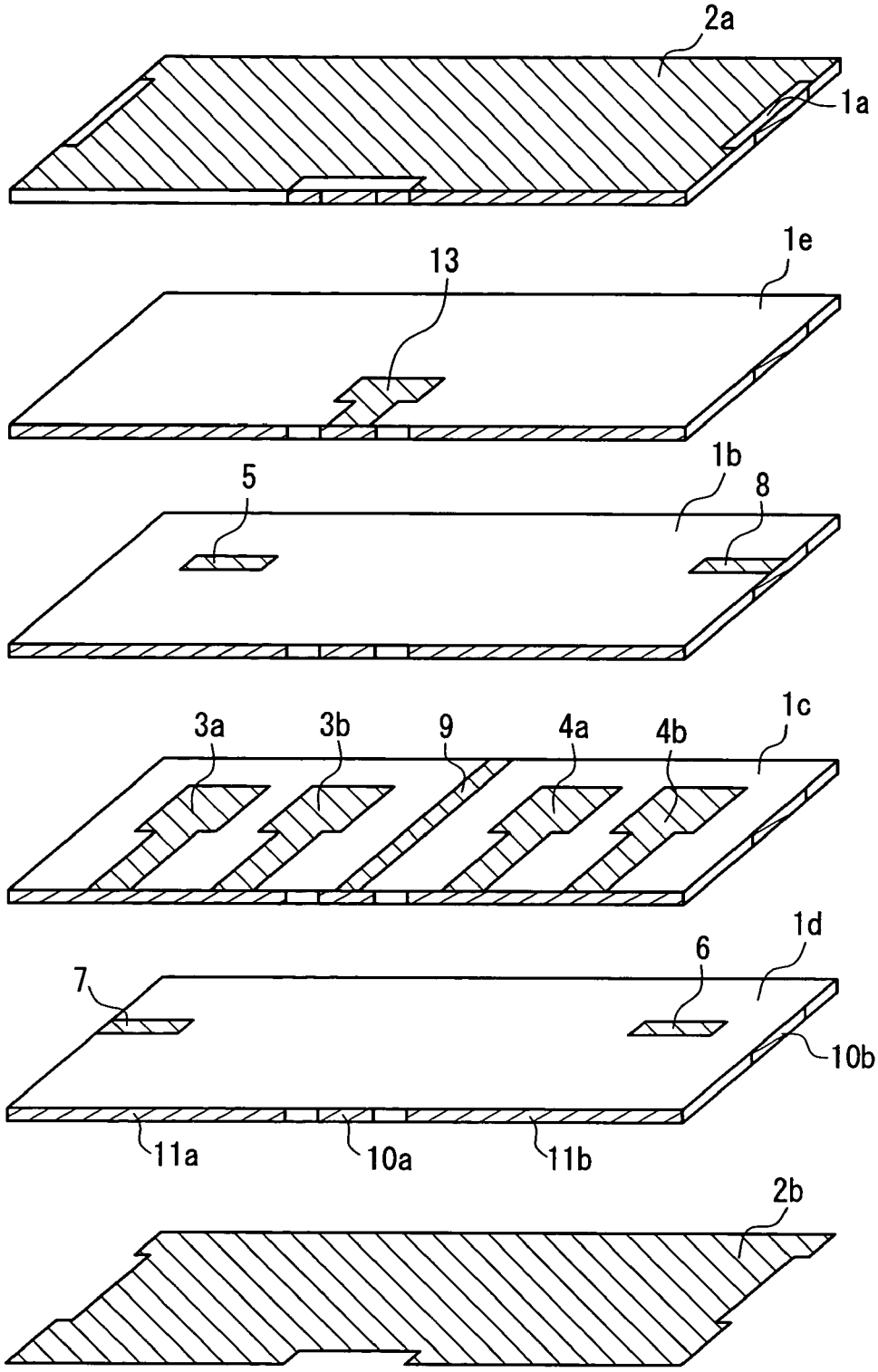
FIG. 12 is an exploded perspective view showing a duplexer according to Embodiment 7 of the present invention.

FIG. 12 is an exploded perspective view showing a duplexer according to Embodiment 7 of the present invention. The duplexer according to the present embodiment is the same as that according to Embodiment 1 shown in FIG. 2 except for the points described below. Therefore, like components are denoted with like reference numerals, and their description will be omitted here.

As shown in FIG. 12, in the duplexer according to the present embodiment, an adjusting capacitive electrode 13 is provided so as to be opposed to the first shield electrode 2*a* with the first dielectric layer 1*a* interposed therebetween. An antenna is used for both transmitting and receiving. The matching between transmitting and receiving can be optimized by providing the adjusting capacitive electrode 13.

Embodiment 8

Figure 13:
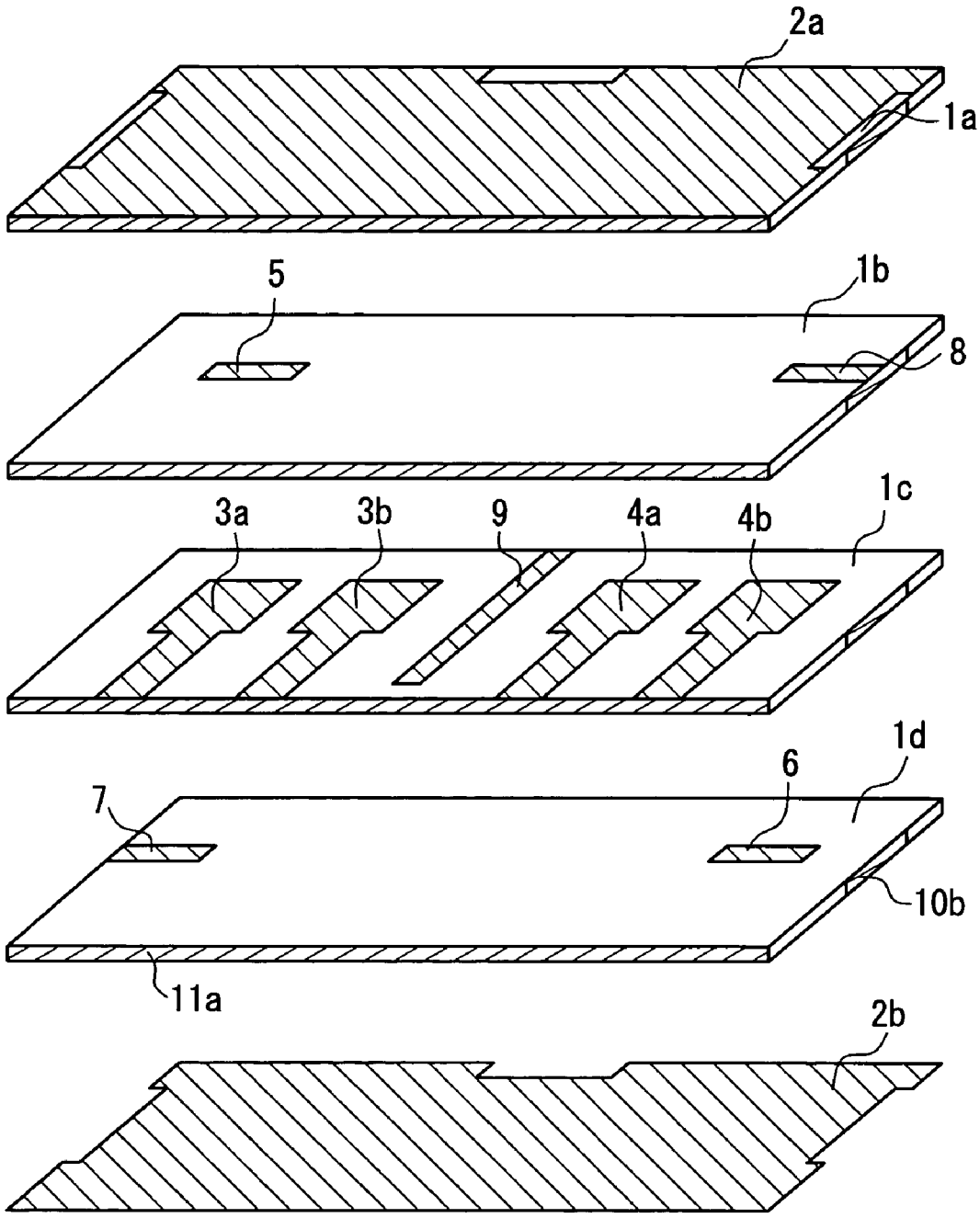
FIG. 13 is an exploded perspective view showing a duplexer according to Embodiment 8 of the present invention.

FIG. 13 is an exploded perspective view showing a duplexer according to Embodiment 8 of the present invention. The duplexer according to the present embodiment is the same as that according to Embodiment 1 shown in FIG. 2 except for the points described below. Therefore, like components are denoted with like reference numerals, and their description will be omitted here.

As shown in FIG. 13, in the duplexer according to the present embodiment, a matching circuit composed of a coupling line 9, having one end that is opened and the other end that is connected to an external terminal, is provided between the first filter and the second filter. Thus, by using the coupling line 9, having one end that is opened and the other end that is connected to an external terminal, a duplexer can be operated.

Figure 14:
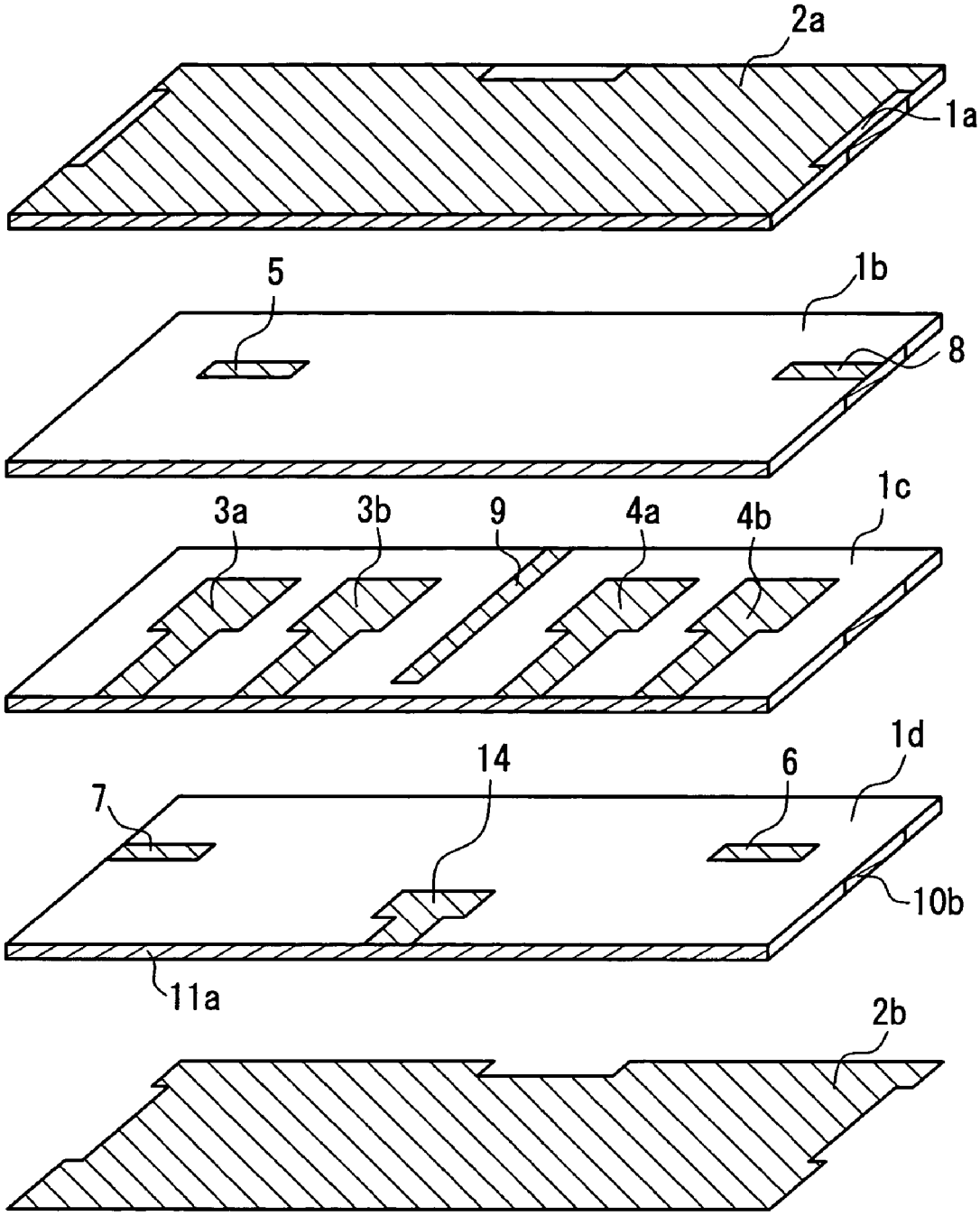
FIG. 14 is an exploded perspective view showing another example of the duplexer according to Embodiment 8 of the present invention.

As a variation of the present embodiment, as shown in FIG. 14, it is desirable that a matching capacitive electrode 14 is provided on an open end side of the coupling line 9 with the third dielectric layer 1*c* interposed therebetween. In the case where one end of the coupling line 9 is opened, floating capacitance is generated on the open end, which causes the variation in capacitance. However, by providing the matching capacitive electrode 14 on the open end side of the coupling line 9 with the third dielectric layer 1*c* interposed therebetween, a capacitance value can be stabilized. Furthermore, by changing the capacitance value of matching capacitance, the degree of design freedom can be obtained.

Figure 15:
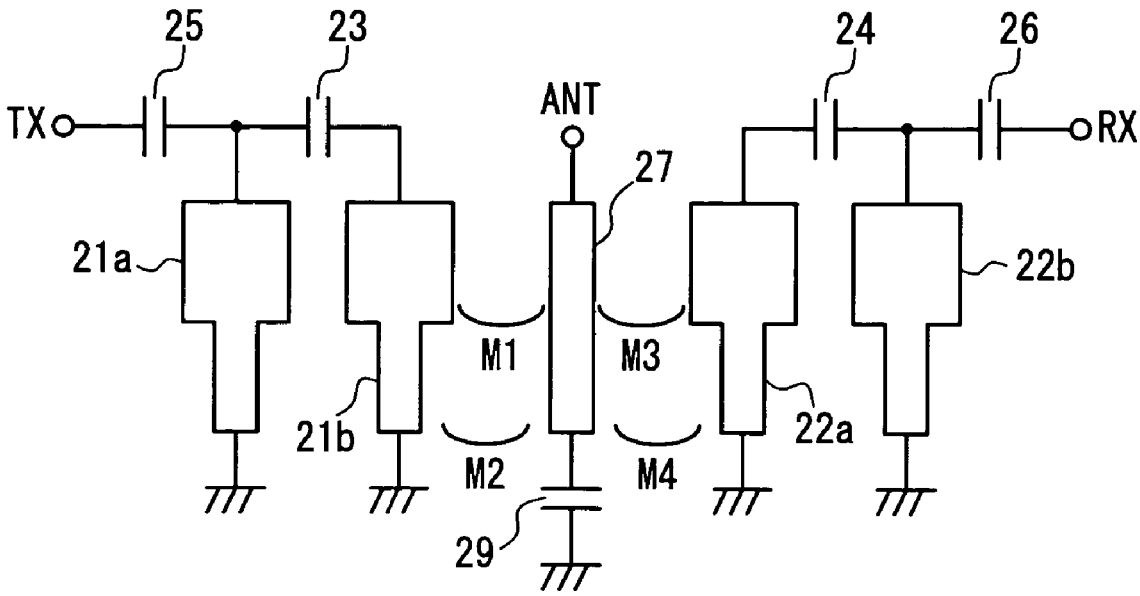
FIG. 15 is an equivalent circuit diagram of the duplexer according to Embodiment 8 of the present invention shown in FIG. 14.

FIG. 15 shows an equivalent circuit of the duplexer shown in FIG. 14. The equivalent circuit shown in FIG. 15 is the same as that shown in FIG. 3 except for the points described below. Therefore, like components are denoted with like reference numerals, and their description will be omitted here.

The equivalent circuit shown in FIG. 15 is different from that shown in FIG. 3, in that a matching capacitor 29 is provided on the open end side of a coupling line 27.

Furthermore, as a variation of the present embodiment, it is desirable to use the configurations described in Embodiments 2 to 5 or 7.

Embodiment 9

Figure 16:
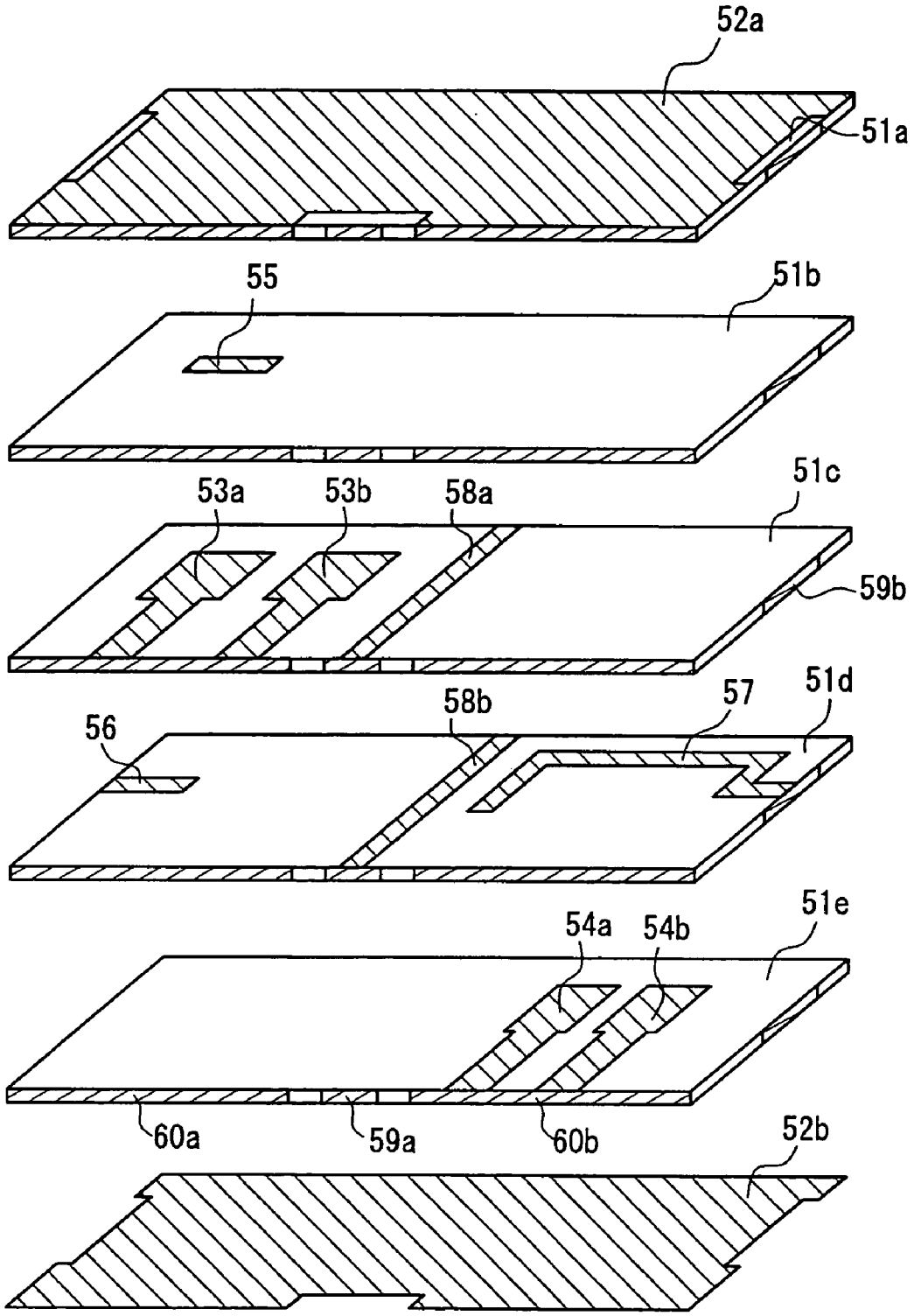
FIG. 16 is an exploded perspective view showing a duplexer according to Embodiment 9 of the present invention.

FIG. 16 is an exploded perspective view showing a duplexer according to Embodiment 9 of the present invention.

As shown in FIG. 16, the duplexer according to the present embodiment is composed of a laminate in which dielectric layers and electrode layers are laminated alternately. In the laminate, a first filter for transmitting and a second filter for receiving having different pass band frequencies are provided. At least one of the first and second filters (second filter in the present embodiment) is composed of second stripline resonators 54*a*, 54*b*, each having one end that is short-circuited and a transmission line 57, having band elimination characteristics. A matching circuit composed of coupling lines 58*a* and 58*b*, each having one end that is short-circuited and the other end that is connected to an external terminal, is provided between the first filter and the second filter. The transmission line 57 is coupled to the coupling line 58*b* by electromagnetic field coupling.

Next, an actual configuration of the duplexer according to the present embodiment will be described in detail.

The laminate includes a first dielectric layer 51*a*, a second dielectric layer 51*b*, a third dielectric layer 51*c*, a fourth dielectric layer 51*d*, and a fifth dielectric layer 51*e* laminated successively.

The electrode layer has the following configuration. A first shield electrode 52*a* is placed on an upper surface of the first dielectric layer 51*a*. An interstage coupling capacitive electrode 55 constituting the first filter is placed between the first dielectric layer 51*a* and the second dielectric layer 51*b*. First resonator electrodes (first stripline resonators) 53*a*, 53*b* constituting the first filter, and the coupling line electrode 58*a* constituting a matching circuit are placed between the second dielectric layer 51*b* and the third dielectric layer 51*c*. An input/output coupling capacitive electrode 56 constituting the first filter, the transmission line electrode 57 constituting the second filter having band elimination characteristics, and the coupling line electrode 58*b* constituting a matching circuit are placed between the third dielectric layer 51*c* and the fourth dielectric layer 51*d*. The second resonator electrodes (second stripline resonators) 54*a* and 54*b* constituting the second filter are placed between the fourth dielectric layer 51*d* and the fifth dielectric layer 51*e*. A second shield electrode 52*b* is placed on a lower surface of the fifth dielectric layer 51*e*. At least three terminal electrodes 59*a*, 59*b* (terminal electrodes corresponding to the input/output coupling capacitive electrode 56 are not shown) connected to the input/output coupling capacitive electrode 56, the transmission line electrode 57, and the coupling line electrodes 58*a*, 58*b* are provided on side surfaces of the first dielectric layer 51*a*, the second dielectric layer 51*b*, the third dielectric layer 51*c*, the fourth dielectric layer 51*d*, and the fifth dielectric layer 51*e*. The first shield electrode 52*a* and the second shield electrode 52*b* are connected by end face electrodes 60*a* and 60*b*.

According to the configuration of the present embodiment, because of the above-mentioned laminated configuration, a filter having band elimination characteristics can be formed easily.

Figure 17:
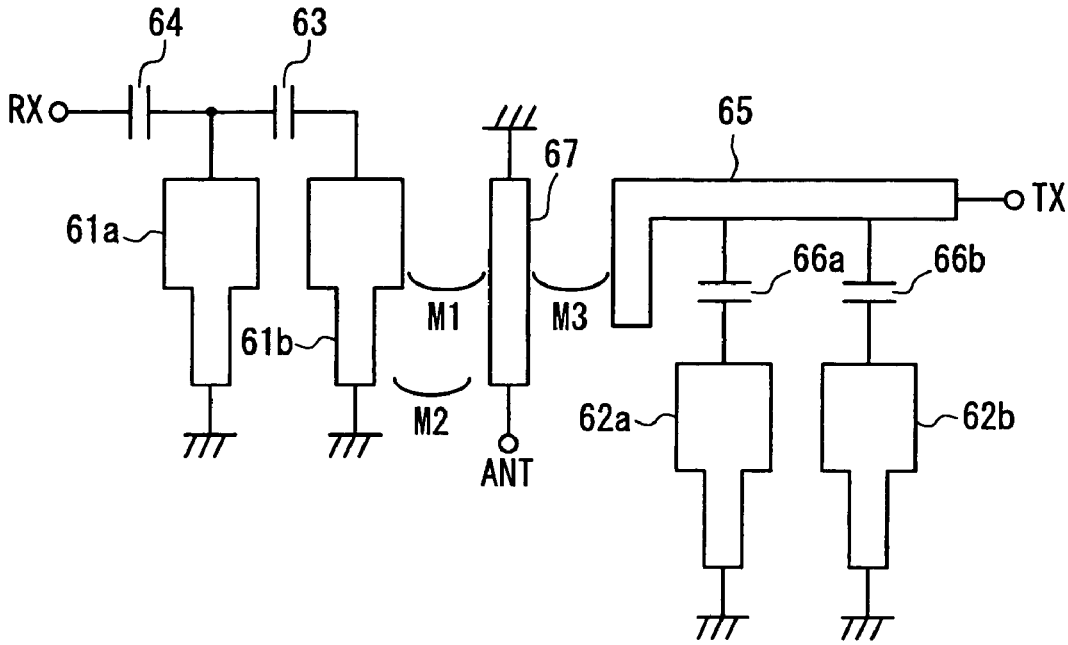
FIG. 17 is an equivalent circuit diagram of the duplexer according to Embodiment 9 of the present invention.

FIG. 17 shows an equivalent circuit of a duplexer having the above-mentioned configuration. As shown in FIG. 17, the duplexer of the present embodiment includes an interstage coupling capacitor 63, an input/output coupling capacitor 64, and a transmission line 65. The first filter includes resonators 61*a* and 61*b*. A resonator 62*a* is connected to the transmission line 65 via a notch capacitor 66*a*, and a resonator 62*b* is connected to the transmission line 65 via a notch capacitor 66*b*.

Figure 18:
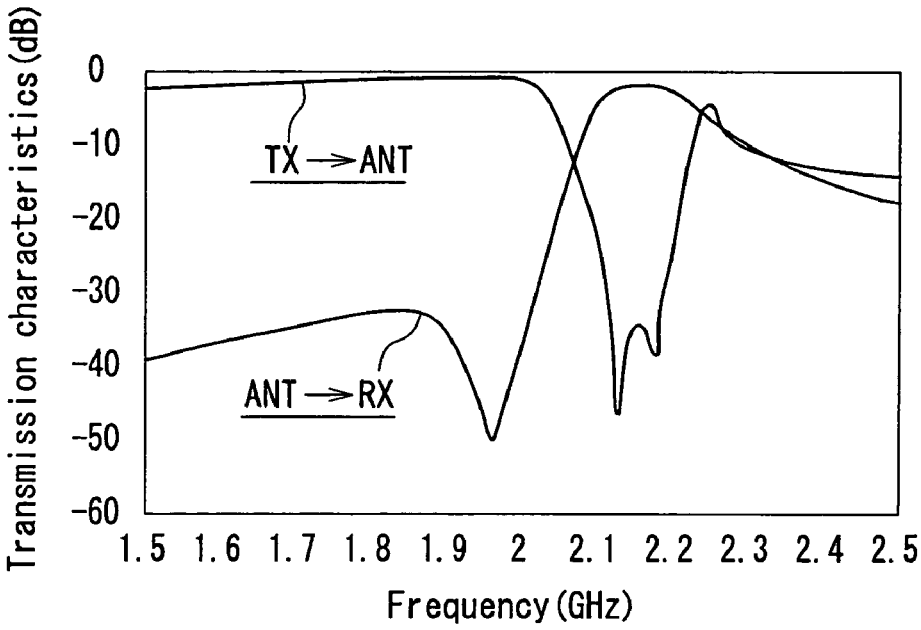
FIG. 18 shows transmission characteristics of the duplexer according to Embodiment 9 of the present invention.

FIG. 18 shows the transmission characteristics of a duplexer having the above-mentioned configuration. In the present embodiment, the second filter for transmitting is composed of the second stripline resonators 54*a*, 54*b*, each having one end that is short-circuited, and the transmission line 57, having band elimination characteristics. Therefore, the second filter eliminates only a particular high-frequency component. The loss can be reduced in the filter having band elimination characteristics, compared with the filter having band pass characteristics. Therefore, the loss of a transmitting filter can be reduced.

Figure 19:
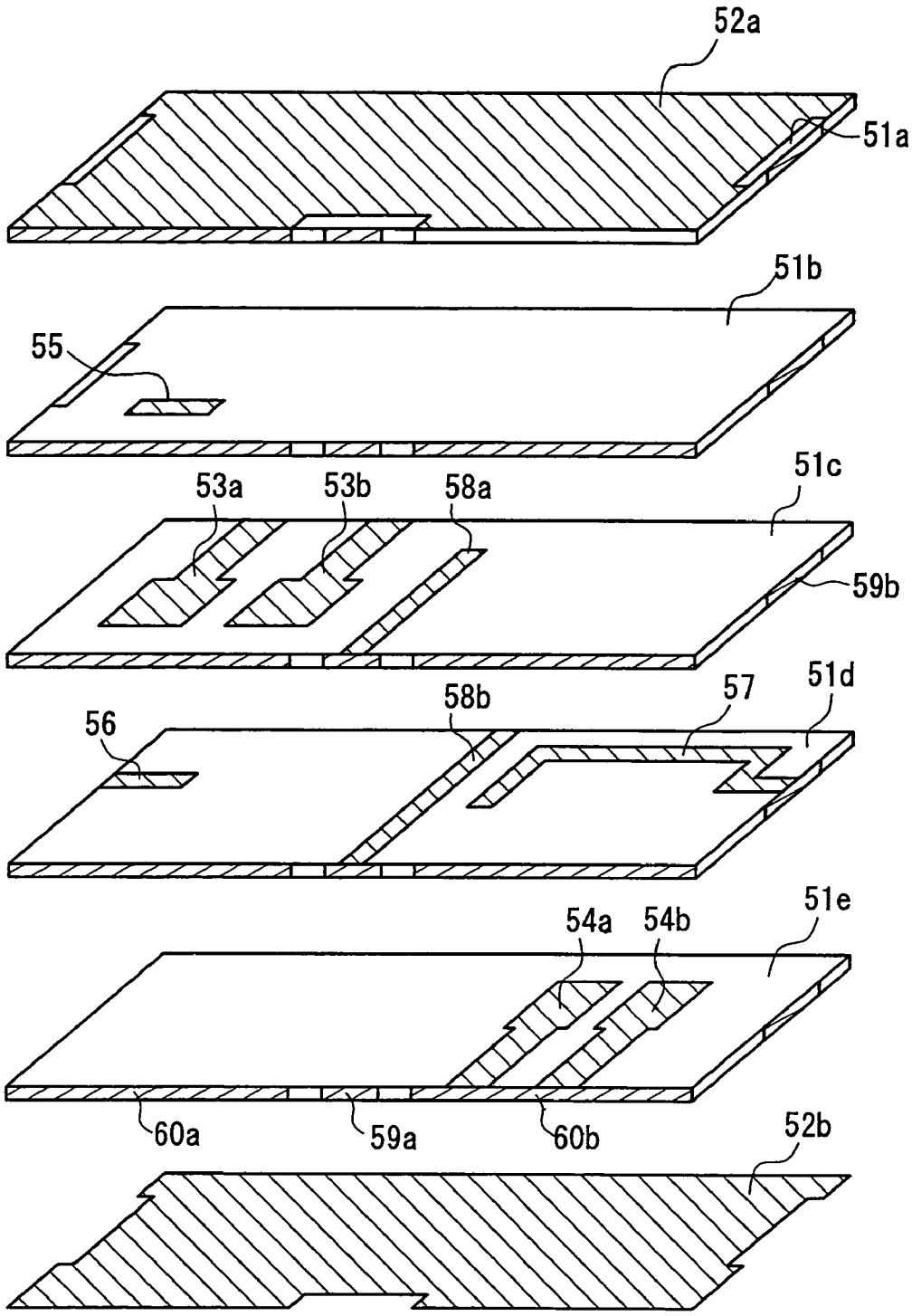
FIG. 19 is an exploded perspective view showing another example of the duplexer according to Embodiment 9 of the present invention.

As a variation of the present embodiment, even when a matching circuit composed of coupling lines 58*a* and 58*b*, each having one end that is opened and the other end that is connected to an external terminal, is provided between the first and second filters as shown in FIG. 19, the same effects can be obtained.

Figure 20:
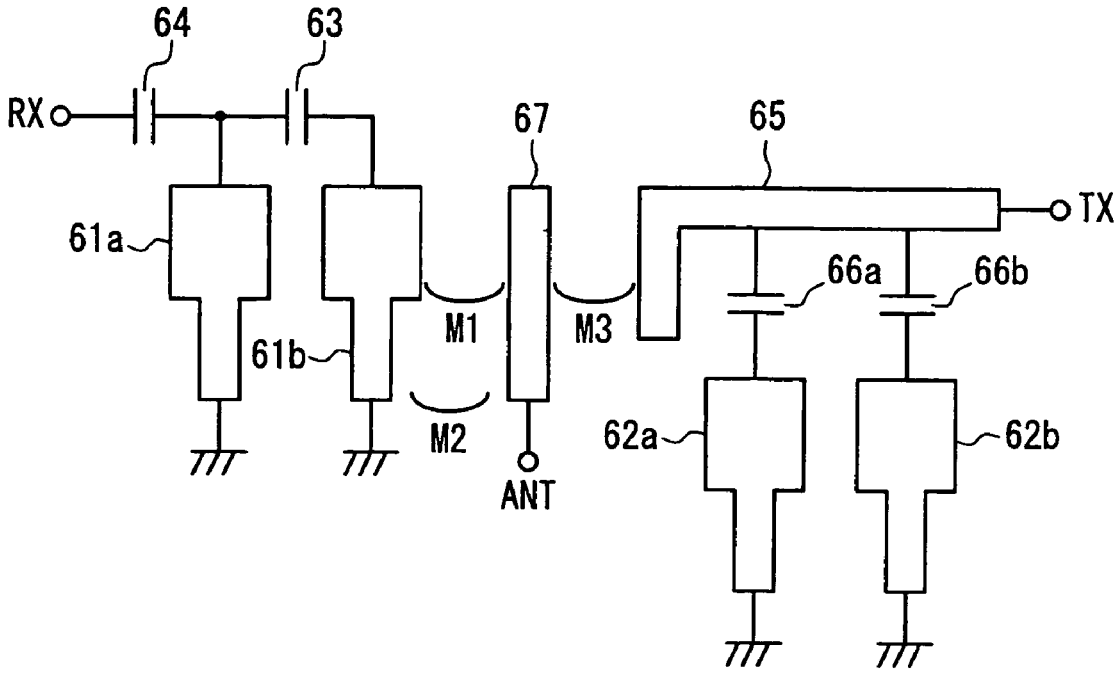
FIG. 20 is an equivalent circuit diagram of the duplexer according to Embodiment 9 of the present invention shown in FIG. 19.

FIG. 20 shows an equivalent circuit of the duplexer shown in FIG. 19.

In the present embodiment, the first filter is configured so as to include the first stripline resonators 53*a*, 53*b*, each having one end that is short-circuited, and the second filter is configured so as to include the second stripline resonators 54*a*, 54*b*, each having one end that is short-circuited. However, the present invention is not limited thereto. The first filter may include three or more first stripline resonators, each having one end that is short-circuited, and the second filter may include three or more second stripline resonators, each having one end that is short-circuited.

Embodiment 10

Figure 21:
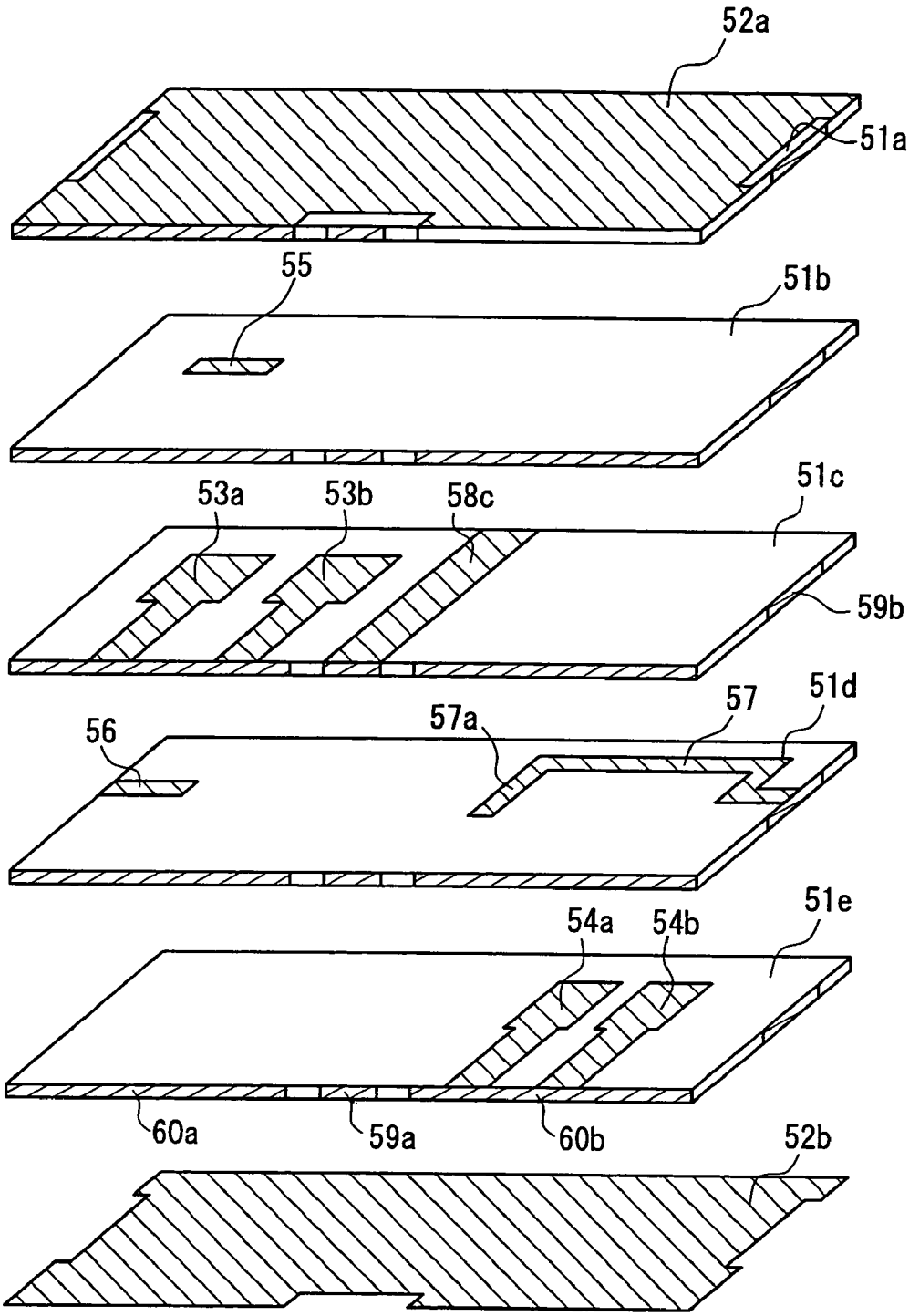
FIG. 21 is an exploded perspective view showing a duplexer according to Embodiment 10 of the present invention.

FIG. 21 is an exploded perspective view showing a duplexer according to Embodiment 10 of the present invention. The duplexer according to the present embodiment is a variation of the duplexer according to Embodiment 9.

As shown in FIG. 21, a laminate includes a first dielectric layer 51*a*, a second dielectric layer 51*b*, a third dielectric layer 51*c*, a fourth dielectric layer 51*d*, and a fifth dielectric layer 51*e* laminated successively.

The electrode layer has the following configuration. A first shield electrode 52*a* is placed on an upper surface of the first dielectric layer 51*a*. An interstage coupling capacitive electrode 55 constituting the first filter is placed between the first dielectric layer 51*a* and the second dielectric layer 51*b*. First resonator electrodes (first stripline resonators) 53*a* and 53*b* constituting the first filter, and a coupling line electrode 58*c* constituting a matching circuit are placed between the second dielectric layer 51*b* and the third dielectric layer 51*c*. An input/output coupling capacitive electrode 56 constituting the first filter and a transmission line electrode 57 constituting the second filter having band elimination characteristics are placed between the third dielectric layer 51*c* and the fourth dielectric layer 51*d*. Second resonator electrodes (second stripline resonators) 54*a* and 54*b* constituting the second filter are placed between the fourth dielectric layer 51*d* and the fifth dielectric layer 51*e*. A second shield electrode 52*b* is placed on a lower surface of the fifth dielectric layer 51*e*. At least three terminal electrodes 59*a*, 59*b* (terminal electrodes corresponding to the input/output coupling capacitive electrode 56 are not shown) connected to the input/output coupling capacitive electrode 56, the transmission line electrode 57, and the coupling line electrode 58*c*, respectively, are provided on side surfaces of the first dielectric layer 51*a*, the second dielectric layer 51*b*, the third dielectric layer 51*c*, the fourth dielectric layer 51*d*, and the fifth dielectric layer 51*e*. The first shield electrode 52*a* and the second shield electrode 52*b* are connected by end face electrodes 60*a* and 60*b*.

A part 57*a* of the transmission line electrode 57 is overlapped with the coupling line electrode 58*c* with the third dielectric layer 51*c* interposed therebetween in a projection in a lamination direction. The width of the part 57*a* of the transmission line electrode 57 is different from that of the coupling line electrode 58*c* in the projection in the lamination direction.

According to the configuration of the present embodiment, the coupling line electrode 58*c* and the transmission line electrode 57 are placed in a vertical direction, so that electromagnetic field coupling becomes further stronger. Furthermore, the width of the part 57*a* of the transmission line electrode 57 is set to be different from that of the coupling line electrode 58*c*, whereby a margin can be provided with respect to a shift in overlapping during lamination. The width of the part 57*a* of the transmission line electrode 57 may be the same as that of the coupling line electrode 58*c*.

Embodiment 11

Figure 22:
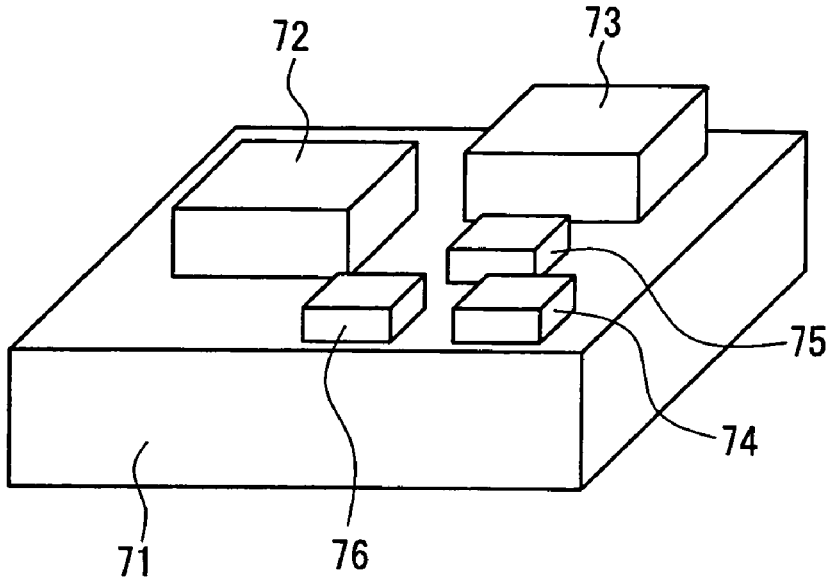
FIG. 22 is a schematic perspective view showing a laminate-type high-frequency device according to Embodiment 11 of the present invention.

FIG. 22 is a schematic perspective view showing a laminate-type high-frequency device according to Embodiment 11 of the present invention. As shown in FIG. 22, the laminate-type high-frequency device according to the present embodiment includes a duplexer composed of a laminate 71 in which dielectric layers and electrode layers are laminated alternately. A semiconductor chip 72, a surface acoustic wave device 73, a PIN diode 74, a chip capacitor 75, and a chip resistor 76 are mounted on an upper surface of the laminate 71.

In the present embodiment, a duplexer having the configuration described in each of the above-mentioned embodiments is used. For example, a first filter for transmitting and a second filter for receiving having different pass band frequencies are provided in the laminate 71. A matching circuit composed of a coupling line, having one end that is short-circuited and the other end that is connected to an external terminal, is provided between the first and second filters. The first filter includes at least one first stripline resonator, having one end that is short-circuited. The second filter includes at least one second stripline resonator, having one end that is short-circuited. The first stripline resonator and the second stripline resonator are coupled to the coupling line by electromagnetic field coupling.

According to the configuration of the present embodiment, a duplexer can be realized with a very simple configuration. Therefore, a laminate-type high-frequency device can be obtained, in which a loss can be reduced substantially and which is provided with a semiconductor chip and/or a surface acoustic wave device.

Embodiment 12

Figure 23:
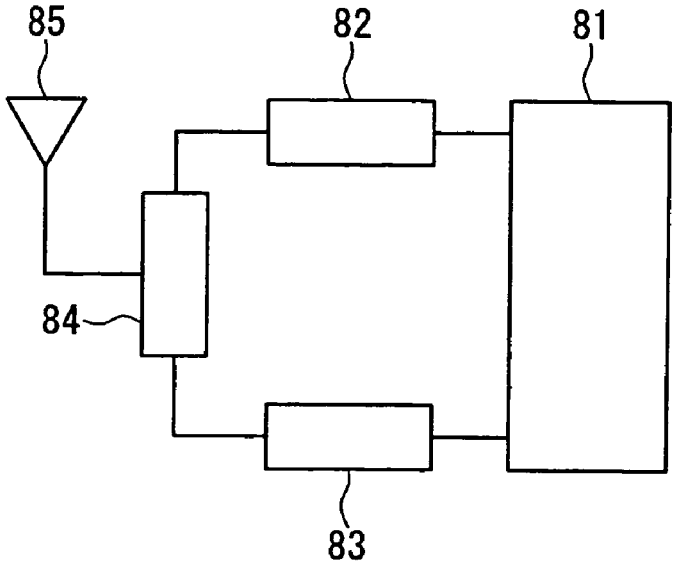
FIG. 23 is a schematic view showing communication equipment according to Embodiment 12 of the present invention.
Figure 24:
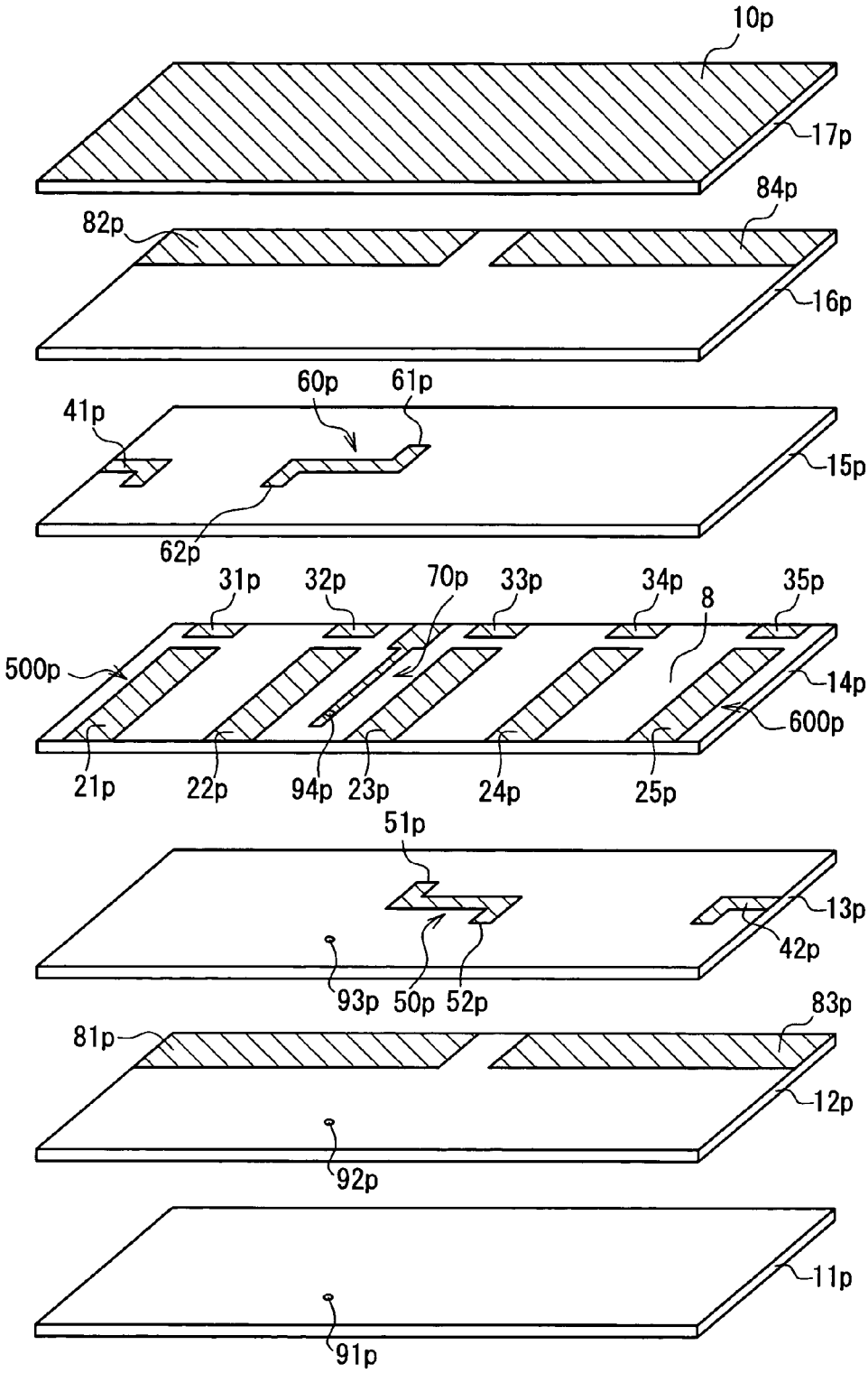
FIG. 24 PRIOR ART
FIG. 24 is an exploded perspective view showing a duplexer in the prior art.
Figure 25:
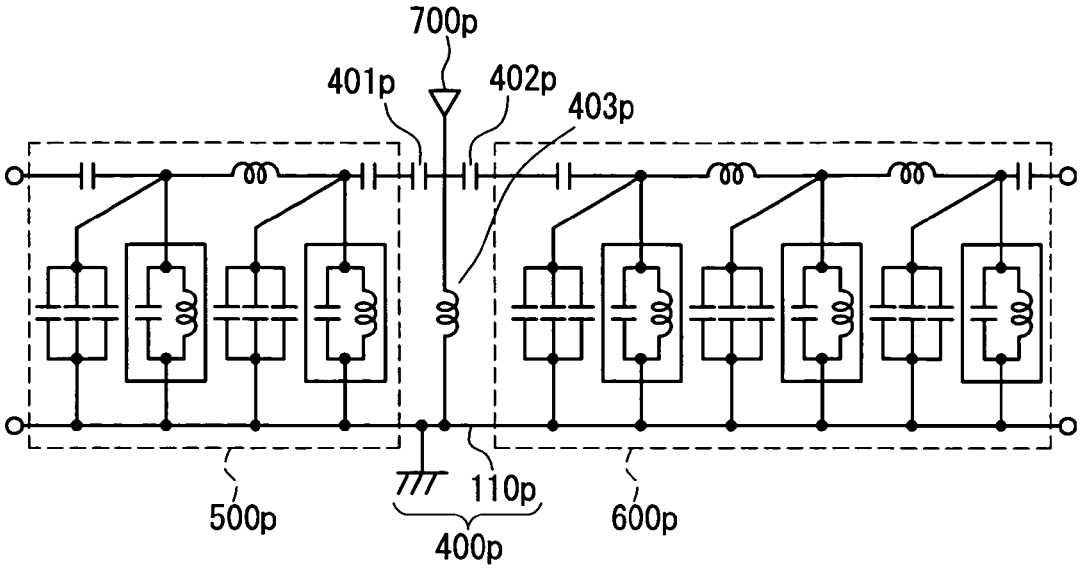
FIG. 25 PRIOR ART
FIG. 25 is an equivalent circuit diagram of the duplexer in the prior art.
Figure 26:
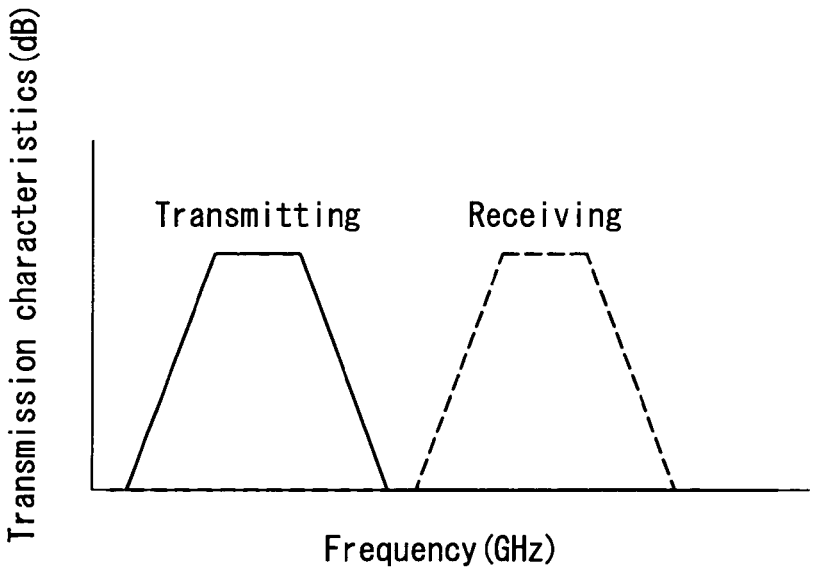
FIG. 26 PRIOR ART
FIG. 26 illustrates the function of a branching circuit.

FIG. 23 is a schematic view showing communication equipment according to Embodiment 12 of the present invention.

As shown in FIG. 23, communication equipment according the present embodiment includes an antenna 85, and a duplexer 84 composed of a laminate in which dielectric layers and electrode layers are laminated alternately, for transmitting a frequency component output from a transmitting circuit to the antenna 85 and transmitting a frequency component received from the antenna 85 to a receiving circuit. The duplexer 84 is connected to a transmitting circuit portion 82 and a receiving circuit portion 83, and the transmitting circuit portion 82 and the receiving circuit portion 83 are connected to a base band portion 81.

As the duplexer 84, a duplexer having the configuration as described in each of the above-mentioned embodiments is used. For example, a first filter for transmitting and a second filter for receiving having different pass band frequencies are provided in a laminate. A matching circuit composed of a coupling line, having one end that is short-circuited and the other end that is connected to an external terminal, is provided between the first and second filters. The first filter includes at least one first stripline resonator, having one end that is short-circuited. The second filter includes at least one second stripline resonator, having one end that is short-circuited. The first stripline resonator and the second stripline resonator are connected to the coupling line by electromagnetic field coupling.

According to the configuration of the present embodiment, a duplexer can be realized with a very simple configuration. Therefore, communication equipment can be obtained, in which a loss can be reduced substantially.

As a variation of the present embodiment, a semiconductor chip and/or a surface acoustic wave device may be mounted on an upper surface of the laminate. According to this configuration, communication equipment can be obtained, including a laminate-type high-frequency device in which a loss can be reduced substantially and which is provided with a semiconductor chip and/or a surface acoustic wave device.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A duplexer comprising a laminate in which dielectric layers and electrode layers are laminated alternately, the laminate comprising a first dielectric layer, a second dielectric layer, a third dielectric layer, and a fourth dielectric layer laminated successively, the duplexer comprising:

a first filter for transmitting and a second filter for receiving, which are provided in the laminate and have different pass band frequencies; and a matching circuit comprising a coupling line formed in a planar shape on one plane of a laminated layer, having one end that is short-circuited and the other end that is connected to an external terminal, provided between the first filter and the second filter, a width of the coupling line being uniform from one end to the other end, wherein the electrode layers include:

a first shield electrode placed on an upper surface of the first dielectric layer;

an interstage coupling capacitive electrode comprising the first filter and an input/output coupling capacitive electrode comprising the second filter, placed between the first dielectric layer and the second dielectric layer;

a first resonator electrode comprising the first filter, a second resonator electrode comprising the second filter, and a coupling line electrode comprising the matching circuit, placed between the second dielectric layer and the third dielectric layer;

an input/output coupling capacitive electrode comprising the first filter and an interstage coupling capacitive electrode comprising the second filter, placed between the third dielectric layer and the fourth dielectric layer;

a second shield electrode placed on a lower surface of the fourth dielectric layer;

at least three terminal electrodes connected to the input/output coupling capacitive electrode comprising the first filter, the input/output coupling capacitive electrode comprising the second filter, and the coupling line electrode, respectively, provided on side surfaces of the first dielectric layer, the second dielectric layer, the third dielectric layer, and the fourth dielectric layer; and an end face electrode connecting the first shield electrode and the second shield electrode to each other, wherein the first filter comprises at least one first stripline resonator formed in a planar shape on the one plane, having one end that is short-circuited, the second filter comprises at least one second stripline resonator formed in a planar shape on the one plane, having one end that is short-circuited, the external terminal connected to the coupling line is on a short-circuited side of the first filter and the second filter, and the first stripline resonator and the second stripline resonator are coupled to the coupling line by electromagnetic field coupling.

2. The duplexer according to claim 1, wherein at least one of the first dielectric layer, the second dielectric layer, the third dielectric layer, and the fourth dielectric layer has a dielectric constant different from that of the other dielectric layers.

3. The duplexer according to claim 1, wherein the coupling line comprises at least two striplines having different line widths, connected to each other.

4. The duplexer according to claim 1, wherein the coupling line comprises a plurality of striplines, and the plurality of striplines are provided on different dielectric layers.

5. The duplexer according to claim 4, wherein at least one of the plurality of striplines has a line width different from that of the other striplines.

6. The duplexer according to claim 4, wherein the plurality of striplines are connected to each other by a via hole.

7. The duplexer according to claim 1, further comprising a coupling capacitor provided so as to be overlapped with the coupling line and the stripline resonators with the dielectric layer interposed therebetween.

8. The duplexer according to claim 1, further comprising an adjusting capacitive electrode provided so as to be opposed to the first shield electrode with the first dielectric layer interposed therebetween.

9. A duplexer comprising a laminate in which at least four dielectric layers and at least two electrode layers are laminated alternately, the laminate comprising a first dielectric layer, a second dielectric layer, a third dielectric layer, and a fourth dielectric layer laminated successively, the duplexer comprising:

a first filter for transmitting and a second filter for receiving, which are provided in the laminate and have different pass band frequencies; and a matching circuit comprising a coupling line, having one end that is opened and the other end that is connected to an external terminal, provided between the first filter and the second filter, wherein the electrode layers include;

a first shield electrode placed on an upper surface of the first dielectric layer;

an interstage coupling capacitive electrode comprising the first filter and an input/output coupling capacitive electrode comprising the second filter, placed between the first dielectric layer and the second dielectric layer;

a first resonator electrode comprising the first filter, a second resonator electrode comprising the second filter, and a coupling line electrode comprising the matching circuit, placed between the second dielectric layer and the third dielectric layer;

an input/output coupling capacitive electrode comprising the first filter and an interstage coupling capacitor electrode comprising the second filter, placed between the third dielectric layer and the fourth dielectric layer;

a second shield electrode placed on a lower surface of the fourth dielectric layer;

at least three terminal electrodes connected to the input/output coupling capacitive electrode comprising the first filter, the input/output coupling capacitive electrode comprising the second filter, and the coupling line electrode, respectively, provided on side surfaces of the first dielectric layer, the second dielectric layer, the third dielectric layer, and the fourth dielectric layer; and an end face electrode connecting the first shield electrode and the second shield electrode to each other, wherein the first filter comprises at least one first stripline resonator, having one end that is short-circuited, the second filter comprises at least one second stripline resonator, having one end that is short-circuited, the external terminal connected to the coupling line is on an end face of an open end side of the first filter and the second filter, and the first stripline resonator and the second stripline resonator are coupled to the coupling line by electromagnetic field coupling.

10. The duplexer according to claim 9, wherein a matching capacitive electrode is connected on an open end side of the coupling line with a dielectric layer interposed therebetween.

11. The duplexer according to claim 9, wherein at least one of the first dielectric layer, the second dielectric layer, the third dielectric layer, and the fourth dielectric layer has a dielectric constant different from that of the other dielectric layers.

12. The duplexer according to claim 9, wherein the coupling line comprises at least two striplines having different line widths, connected to each other.

13. The duplexer according to claim 9, wherein the coupling line comprises a plurality of striplines, and the plurality of striplines are provided on different dielectric layers.

14. The duplexer according to claim 13, wherein at least one of the plurality of striplines has a line width different from tat of the other striplines.

15. The duplexer according to claim 13, wherein the plurality of striplines are connected to each other by a via hole.

16. The duplexer according to claim 9, further comprising a coupling capacitor provided so as to be overlapped with the coupling line and the stripline resonators with the dielectric layer interposed therebetween.

17. The duplexer according to claim 9, further comprising an adjusting capacitive electrode provided so as to be opposed to the first shield electrode with the first dielectric layer interposed therebetween.

18. A laminate-type high-frequency device, comprising:

a duplexer comprising a laminate in which dielectric layers and electrode layers are laminated alternately; and a semiconductor chip and/or a surface acoustic wave device mounted on an upper surface of the laminate, wherein, as the duplexer, the duplexer of claim 1 is used.

19. Communication equipment, comprising:

an antenna; and a duplexer for transmitting a frequency component output from a transmitting circuit to the antenna and transmitting a frequency component received from the antenna to a receiving circuit, comprising a laminate in which dielectric layers and electrode layers are laminated alternately, wherein, as the duplexer, the duplexer of claim 1 is used.

20. Communication equipment according to claim 19, further comprising at least one selected from a semiconductor chip and a surface acoustic wave device mounted on an upper surface of the laminate.

21. A laminate-type high-frequency device, comprising:

a duplexer comprising a laminate in which dielectric layers and electrode layers are laminated alternately; and a semiconductor chip and/or a surface acoustic wave device mounted on an upper surface of the laminate, wherein, as the duplexer, the duplexer of claim 9 is used.

22. Communication equipment, comprising:

an antenna; and a duplexer for transmitting a frequency component output from a transmitting circuit to the antenna and transmitting a frequency component received from the antenna to a receiving circuit, comprising a laminate in which dielectric layers and electrode layers are laminated alternately, wherein, as the duplexer, the duplexer of claim 9 is used.

23. The duplexer according to claim 1, wherein the first and second stripline resonators are arranged symmetrically along a center axis.

24. The duplexer according to claim 9, wherein the first and second stripline resonators are arranged symmetrically along a center axis.

* * * * *